US012486771B2

(12) United States Patent
Cariveau et al.

(10) Patent No.: US 12,486,771 B2
(45) **Date of Patent: *Dec. 2, 2025**

(54) ROTOR TILT COMPENSATION IN PDM STATORS

(71) Applicant: Abaco Drilling Technologies LLC, Houston, TX (US)

(72) Inventors: Peter Thomas Cariveau, Houston, TX (US); Timothy Mark Miller, Klein, TX (US); Jing Lu, Houston, TX (US)

(73) Assignee: Abaco Drilling Technologies LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/828,379

(22) Filed: Sep. 9, 2024

(65) Prior Publication Data

US 2024/0426214 A1 Dec. 26, 2024

Related U.S. Application Data

(63) Continuation of application No. 18/482,153, filed on Oct. 6, 2023, now Pat. No. 12,084,975, which is a continuation of application No. 18/048,336, filed on Oct. 20, 2022, now Pat. No. 11,808,153, which is a continuation of application No. 17/891,593, filed on (Continued)

(51) Int. Cl.

| | |
|---|---|
| ***F01C 1/10*** | (2006.01) |
| ***E21B 4/02*** | (2006.01) |
| ***F04C 2/107*** | (2006.01) |
| ***F04C 13/00*** | (2006.01) |

(52) U.S. Cl.

CPC ..... *F01C 1/101* (2013.01); *E21B 4/02* (2013.01); *F04C 2/1075* (2013.01); *F04C 13/008* (2013.01); *F04C 2240/10* (2013.01); *F04C 2250/30* (2013.01)

(58) Field of Classification Search

CPC ..... F04C 2/1071–1078; F04C 18/1075; F01C 1/101; F01C 1/107; E21B 4/02

See application file for complete search history.

(56) References Cited

U.S. PATENT DOCUMENTS

| | | | |
|---|---|---|---|
| 3,771,906 | A | 11/1973 | Bourke |
| 5,120,204 | A | 6/1992 | Mathewson et al. |

(Continued)

FOREIGN PATENT DOCUMENTS

| | | | |
|---|---|---|---|
| DE | 4312123 | A1 | 10/1994 |
| WO | 2005/064114 | A1 | 7/2005 |
| WO | 2021/009275 | A1 | 1/2021 |

OTHER PUBLICATIONS

ASTM international publication D412: "Standard Test Methods for Vulcanized Rubber and Thermoplastic Elastomers—Tension", 2016 edition last updated in Jun. 2021.

(Continued)

*Primary Examiner* — Laert Dounis

(74) *Attorney, Agent, or Firm* — Zeman-Mullen & Ford, LLP

(57) ABSTRACT

Minor diameter enlargements are engineered into a stator in a positive displacement motor (PDM) power section to relieve stator stress concentrations at the lower (downhole) end of the power section in the presence of rotor tilt. The minor diameter enlargements may include one or more contoured stress relief lengths according to various tapered or step functions.

22 Claims, 21 Drawing Sheets

Related U.S. Application Data

Aug. 19, 2022, now abandoned, which is a continuation of application No. 17/221,698, filed on Apr. 2, 2021, now Pat. No. 11,421,533.

(60) Provisional application No. 63/004,263, filed on Apr. 2, 2020.

(56) References Cited

U.S. PATENT DOCUMENTS

| | | | |
|---|---|---|---|
| 5,722,820 | A | 3/1998 | Wild et al. |
| 6,358,027 | B1 | 3/2002 | Lane |
| 6,457,958 | B1 | 10/2002 | Dunn |
| 7,192,260 | B2 | 3/2007 | Lievestro et al. |
| 7,396,220 | B2 | 7/2008 | Delpassand |
| 7,741,392 | B2 | 6/2010 | Nasreddine et al. |
| 7,987,908 | B2 | 8/2011 | Colley, III |
| 8,556,603 | B2 | 10/2013 | Ree |
| 8,899,351 | B2 | 12/2014 | Hay et al. |
| 9,091,264 | B2 | 7/2015 | Hohl et al. |
| 9,109,595 | B2 | 8/2015 | Daunheimer |
| 10,215,176 | B2 | 2/2019 | Cariveau et al. |
| 10,989,189 | B2 | 4/2021 | Pushkarev et al. |
| 11,015,603 | B2 | 5/2021 | Cariveau et al. |
| 11,421,533 | B2 | 8/2022 | Cariveau et al. |
| 11,808,153 | B2 | 11/2023 | Cariveau et al. |
| 2004/0258548 | A1 | 12/2004 | Zitka et al. |
| 2005/0118040 | A1 | 6/2005 | Zitka et al. |
| 2005/0285305 | A1 | 12/2005 | Neuroth |
| 2014/0119974 | A1 | 5/2014 | Kitching |
| 2014/0170011 | A1 | 6/2014 | Clouzeau et al. |
| 2016/0040480 | A1 | 2/2016 | Evans |
| 2016/0208798 | A1 | 7/2016 | Sawyer |
| 2016/0348508 | A1 | 12/2016 | Purcell et al. |
| 2018/0003174 | A1 | 1/2018 | Ba et al. |
| 2019/0145374 | A1 | 5/2019 | Parhar et al. |
| 2020/0256311 | A1 | 8/2020 | Parhar et al. |
| 2021/0262468 | A1 | 8/2021 | Cariveau et al. |
| 2021/0310486 | A1 | 10/2021 | Cariveau et al. |
| 2022/0364559 | A1 | 11/2022 | Kolyshkin et al. |
| 2024/0044251 | A1 | 2/2024 | Cariveau et al. |

OTHER PUBLICATIONS

Slide show presentation by Abaco Drilling Technologies in webcast hosted by World Oil magazine, first broadcast Jul. 16, 2020: "Drilling Case Studies: Increasing Power Section reliability and reducing field failure".

Narayanan, Shakar Bhaskaran, Master's Thesis entitled "Fluid Dynamic and Performance Behavior of Multiphase Progressive Cavity Pumps", Aug. 2011.

Qiang, Zhang, et al., "Analysis of Influence of Swelling on Interference of Stator and Rotor of Progressing Cavity Pump"; China Petroleum Machinery, 2018, 46(5): 71-76.

Abaco Drilling Technologies, Power Section Product Sheet for Model No. AT700678.4; downloaded from www. abacodrilling.com/catalog on Jul. 15, 2022.

Dyna-Drill, Power Section Product Sheet for Model No. DD700676.5; downloaded from www.dyna-drill.com/spec-sheet-search on Aug. 12, 2022.

Xiangdong, He, et al., "Design of Stator Profiles for Screw Pumps Based on Thermal Swelling and Swelling Characteristics", Engineering Mechanics, Jul. 2011, pp. 196-202, vol. 28, No. 7.

PV Fluid Products, Power Section Specification Sheet for Model No. PV675650-HS-0; downloaded from www.pvfluid.com/products on Aug. 12, 2022.

Alvarez, Alfredo A., et al., "Predicting Rotor-Stator Fit in Positive Displacement Motors PDMs", Society of Petroleum Engineers SPE/IADC-184688-MS, SPE/IADC Drilling Conference and Exhibition 2017.

Slide show presentation by Abaco Drilling Technologies in webcast hosted by World Oil magazine, first broadcast Apr. 21, 2021: "Innovative Power Section Design Drives Performance and Improves Reliability".

Abaco Drilling Technologies, Power Section Product Sheet for Model No. AT500566.7 rev date Oct. 15, 2020.

Abaco Drilling Technologies, Power Section Product Sheet for Model No. AT500566.7 rev date Jan. 11, 2019.

Rotor Eccentric Motion Trace (350 GPM)

ROTOR TILT COMPENSATION IN PDM STATORS

RELATED APPLICATIONS

This application is a continuation of commonly-owned and commonly-invented U.S. Nonprovisional patent application Ser. No. 18/482,153 filed Oct. 6, 2023 (U.S. Pat. No. 12,084,975). Ser. No. 18/482,153 is a continuation of commonly-owned and commonly-invented U.S. Nonprovisional patent application Ser. No. 18/048,336 filed Oct. 20, 2022 (U.S. Pat. No. 11,808,153), which is a continuation of commonly-owned and commonly-invented U.S. Nonprovisional patent application Ser. No. 17/891,593 filed Aug. 19, 2022 (abandoned), which is a continuation of commonly-owned and commonly-invented U.S. Nonprovisional patent application Ser. No. 17/221,698 filed Apr. 2, 2021 (U.S. Pat. No. 11,421,533). Ser. No. 17/221,698 claims the benefit of and priority to commonly-owned and commonly-invented U.S. Provisional Patent Application Ser. No. 63/004,263 filed Apr. 2, 2020. The disclosures of Ser. No. 18/482,153, Ser. No. 18/048,336, Ser. No. 17/891,593, Ser. No. 17/221,698 and 63/004,263 are incorporated herein by reference as if fully set forth herein.

BACKGROUND

The term "positive displacement motor" (or "PDM") is used interchangeably in this disclosure with the term "PDM power section" for short form convenience unless stated otherwise. A PDM power section conventionally comprises a PDM stator and associated rotor, as is well known in the art. Positive displacement motors (PDMs) are conventionally placed above the bit in subterranean oil and gas drilling. Drilling operations (both conventional and directed) gain advantage when PDMs can deliver high power output. Stiff, high modulus elastomers deployed in the stators assist in high power delivery. Such elastomers (rubbers) form tight pressure pockets in helical progressing cavities where the rotor lobes are in interference fits with the stator lobes.

High power PDMs derive and build desirable high torque from high fluid pressure drops across the length of the PDM. High power PDMs are advantageously designed to be "inefficient" or "leaky" at the rotor lobe/stator lobe interference fits across the entire length of the PDM to enable a high pressure drop from inlet to outlet. Ideally, the fluid pressure drops linearly from max at inlet to zero at outlet. As a result, all stages of the PDM become available to build torque. Ideally, an overall fluid pressure drop above 180 psi per stage will produce acceptable high power drilling efficiency (although this example is non-limiting and offered for illustration only).

"Leaky" interference fits nonetheless lead to stress concentrations in the stator rubber, especially at points of contact between rotor lobes and stator lobes. This effect is magnified when the stator rubber is a stiff, high modulus material. "Leaky" interference fits can also contribute to or be associated with PDM performance issues, one of which is rotor tilt.

"Rotor tilt" refers to displacement of the rotor off its expected eccentric orbital rotation path by imbalanced forces that arise across the rotor. Rotor tilt may sometimes be referred to in this disclosure as "rotor deflection". Rotor tilt is a common problem seen in high power PDMs designed to be "inefficient" or "leaky" in order to promote high torque generation. Rotor tilt is particularly problematic in the final region near the outlet end of such PDMs.

Rotor tilt is initially caused by high fluid pressure at the inlet end bearing upon a larger rotor surface area on the non-eccentric side of orbital rotation than on the eccentric side. The resulting net force causes to the rotor to displace (tilt) eccentrically, such that the rotor lobe on the eccentric side "digs" into the stator valley as it rolls over the stator valley. The rotor's eccentric displacement causes the interference fits between rotor and stator lobes on the non-eccentric side to separate, causing additional leakiness. This rotor tilt effect continues along the length of the PDM towards the outlet until a critical point is reached. This critical point is typically located at about 10% PDM length to about 50% PDM length from the outlet. The imbalanced force kinetics change at this point. In the final region near the outlet, lower overall ambient fluid pressure and leaky interference fits reduce the local pocket pressures on the non-eccentric side of the rotor. As the outlet approaches, these local pressures can tend towards zero. Meanwhile, ambient fluid pressure continues to exist on the eccentric side of the rotor where there is no leakiness. The resulting net force across the rotor causes the rotor now to displace (tilt) non-eccentrically, such that the rotor lobes on the non-eccentric side (either side of open pockets) "dig" into stator lobes. This causes high stress concentrations on the stator lobes. High rubber strains are required to enable the rotor lobes to pass over the stator lobes as the rotor rotates. Many rubbers, and especially high modulus rubbers, lack the elongation to permit the strain, causing rupture and tearing of the stator lobes. Moreover, stall (or near stall) events can occur as leaky interference fits make local pocket pressures on the non-eccentric side of the rotor tend towards zero.

The foregoing general description of rotor tilt is illustrated schematically on FIG. 1. The top bar on FIG. 1 represents a continuum 10 of eccentric displacement of the rotor from its normal rotation orbit. The left end of the continuum 10L represents rotor behavior when the rotor is tilted eccentrically (i.e. to increase its normal rotational orbit). Frictional heating at 10L is minimized. The right end of the continuum 10R represents rotor behavior when the rotor is tilted non-eccentrically (i.e. to decrease its normal rotational orbit). Frictional heating at 10R is maximized.

FIG. 1 also depicts three schematic power section views 10A, 10B and 10C, each illustrating power section behavior typical at corresponding positions 10L, 10M and 10R along continuum 10. Power section views 10A, 10B, 10C each have the following common features:

- Stator 11L, 11M and 11R;
- Rotor 12L, 12M and 12R;
- Rolling contact 13L, 13M and 13R;
- Interference fits 14L, 14M and 14R;
- Directions of rotor rotation 15*l*, 15M and 15R;
- Nominal (design) orbits of rotation of rotor centers 16L, 16M and 16R; and
- Actual orbits of rotation of rotor centers 17L, 17M and 17R.

Power section view 10B on FIG. 1, corresponding to behavior halfway along continuum 10 at position 10M, illustrates paradigmatic orbital rotation of the rotor 12M in which there are no extrinsic forces tilting the rotor (i.e. the PDM is in a state of "distributed pressure"). There is no leaking. The lobes of rotor 12M make normal sliding contact with the lobes of stator 11M at the interference fits 14M on the non-eccentric side. The paradigm of power section view 10B is likely seen in low power, low fluid pressure PDMs where there is little to no pressure drop until a region very near the outlet.

Power section view 10A on FIG. 1, corresponding to behavior at position 10L on continuum 10, imitates rotor tilt as described above at the inlet end in high pressure PDMs. The rotor 12L tilts eccentrically ("biased pressure outwards") due to the rotor 12L presenting a higher cross-sectional area on the non-eccentric side on which the fluid pressure may act than on the eccentric side. The rotor lobe on the eccentric side "digs" into the stator valley as it rolls over the stator valley. The rotor's eccentric displacement causes the interference fits 14L between rotor and stator lobes on the non-eccentric side to separate ("no sliding contact").

Power section view 10C on FIG. 1, corresponding to behavior at position 10R on continuum 10, imitates rotor tilt as described above in the final region near the outlet end in high pressure PDMs. The rotor 12R tilts non-eccentrically ("biased pressure inwards") due to the local fluid pressure imbalance across the rotor 12R. Local pocket pressures on the non-eccentric side of the rotor tend towards zero, while ambient fluid pressure acts from the eccentric side of the rotor 12R where there is no leakiness. The rotor's non-eccentric displacement causes the interference fits 14R between rotor and stator lobes on the non-eccentric side to engage heavily ("heavy sliding contact").

The prior art does not appear to have addressed the problem of rotor tilt as seen in high power PDMs. Certain references have addressed remediation of stator rubber stress concentrations due to other performance issues such as thermal expansion and PDM bending in deviated wells. Some references speak directly to thermal expansion remediation in progressing cavity pumps (PCPs). These references are not germane to the design considerations set forth herein for addressing rotor tilt in PDMs. It is well understood that ambient fluid pressures drop in a PDM as the fluid travels from the inlet end (near the surface) to the outlet end (near the bit). This is opposite to PCPs, in which ambient fluid pressure is lowest at the inlet end, and increases as the fluid is lifted towards the outlet. Indeed, conventional PCP technology such as described in U.S. Pat. No. 5,722,820 ("Wild") and S. B. Narayanan, *Fluid Dynamic and Performance Behavior of Multiphase Progressive Cavity Pumps* (Thesis submitted to the Office of Graduate Studies of Texas A&M University, August 2011) do not acknowledge or address rotor tilt as an effect. As noted, these references are concerned exclusively with remediating rubber friction due to thermal expansion and multiphase fluid volume changes. Moreover, the PCPs disclosed in Wild have low rotor eccentricity at the inlet and high rotor eccentricity at the outlet, which, as further described herein, is the opposite result of the effect of rotor tilt in a PDM.

U.S. Pat. No. 9,869,126 ("Evans") discloses a variety of high-level solutions to elastomer stress issues in both PCPs and PDMs. Problems sought to be addressed in Evans include wear of the elastomer from (a) elevated temperature, (b) solids in the drilling fluid, (c) corrosive drilling fluid, (d) swelling, (e) misalignment of mechanical parts, and (f) bending of the PCP/PDM in deviated wells. Rotor tilt is not acknowledged or addressed. Evans is thus also not germane to the design considerations set forth herein for addressing rotor tilt in PDMs.

U.S. Published Patent Application 2019/0145374 ("Parhar") discusses pressure distributions in PDM power sections, but does not address rotor tilt. Paragraph 0079 of Parhar states that the effects of angular deflection of the rotor may be considered negligible for the purpose of Parhar's disclosure. Parhar's disclosure further does not contemplate rubber damage issues near the outlet end and/or stall events.

Parhar thus does not address the rubber stress concentrations, particularly at the outlet end, that are characteristic of PDMs susceptible to rotor tilt. Parhar does not address the stall events, torque loss and stator damage caused by rotor tilt. Parhar is therefore not germane to the design considerations for addressing rotor tilt in PDMs as set forth in this disclosure.

It should be noted that rotor tilt is essentially independent of the number of stages that a particular PDM may provide, and thus is indifferent to such configurations. Observation and remediation of rotor tilt is based on the entire length of the PDM from inlet to outlet. PDMs typically see the adverse effects of rotor tilt take the form of significant elastomer stress in a region from zero to 25%-50% of the PDM's overall length measured from the outlet. As noted, rotor tilt moves the rotor off its normal orbital rotation, which causes increased friction at points of contact between rotor and stator. As rotor tilt increases, stall and near-stall loading events may cause more serious stator damage, and even failure. Elastomeric linings may deflect as much as 40% strain when rotor tilt is creating stall conditions, whereupon all fluid may bypass rotor/stator interfaces, sending the rotor output RPM to zero.

Higher modulus rubbers tend to call for higher fluid pressures at stall, although the strain required to stall the motor does not change significantly. The increase in pressure gradient in higher modulus rubber deployments has the effect instead of creating a more pronounced rotor tilt over the PDM's length than might be seen with lower modulus materials. In addition, higher modulus materials typically have a reduced elongation at break than lower modulus materials, suggesting that rotor tilt is more likely to cause stator lobe tear and breakoff in higher modulus deployments.

For example, power section designs using elastomer compositions with 100% modulus greater than 800 psi are optimal to increase drilling efficiencies. However, the elongation at break for such stiffer and harder rubbers is reduced from over 300% (as seen in softer rubbers) to less than 270% and as low as 80%. The required elongation to survive a stalling event is at least approximately 35% to 50% strain. This approximate strain range is the deflection required to cause the motor to bypass 100% of the fluid and bring the output rpm to zero (stall). This strain range is further substantially independent of stiffness. The potential for stiff and hard rubbers to exceed the elongation at break (tensile strength) during rotor tilt, and thereby tear the elastomer, becomes much higher.

Further, the rotor may become so tilted, and the local fluid pressure drop from leaky interference fits may become so great that too much torque is lost to sustain rotor rotation. The rotor stalls. This can be a catastrophic event. The bit stops. However, the borehole assembly components above the PDM may continue to rotate. The rotor responds by oscillating and "thrashing about" in an uncontrolled orbital rotation. This uncontrolled rotor motion may cause extensive local damage to the stator, transmission and other components.

There is therefore a need in the art for design technology directed exclusively to remediating the adverse effects of rotor tilt in PDMs.

SUMMARY

This disclosure describes embodiments of tapered stator designs that are engineered to reduce the stress concentration at the lower end of the power section in the presence of rotor tilt. The disclosed technology is particularly advantageous in high modulus rubber deployments, although the scope of this disclosure is not limited to high modulus rubber materials. A contoured stress relief (i.e. a taper) is provided in the stator to compensate for rotor tilt, where the taper is preferably more aggressive at the lower end of the stator near the bit. Preferably, the taper is engineered into the minor diameter of the stator profile and thus modifies the stator lobe height only. The scope of this disclosure is not limited, however, to tapers on the minor diameter of the stator. Minor diameter taper embodiments on the stator allow the rotor to remain unmodified. This in turn allows the full design cross section of the rotor to be maintained. This is advantageous, since tapering the rotor (and thereby reducing cross section) might otherwise diminish the rotor's overall strength. Further, removing material from the rotor might destabilize the rotor at high rpm. Tapering the stator instead, preferably on the minor diameter of the stator, enables rubber stress concentrations to be reduced. By reducing the rubber stress concentrations from rotor tilting, the ratio of stall stress to elongation at break is significantly improved.

As noted, this disclosure describes tapered power sections to remediate rotor tilt, preferably providing aggressive tapers near the bottom end of the PDM near the bit (although the scope of this disclosure is not limited in this regard). As highlighted in the "Background" section above, the prior art does not even acknowledge this problem, let alone try to solve it. Instead, the PCP prior art discloses gently tapered power sections to solve thermal expansion problems so as to distribute power more evenly across multiple PDM stages. Evans discloses use of tapered power sections to remediate a number of problems other than rotor tilt, including fluid leakage (and power loss) when the bottom of the PDM is bent while drilling a deviated well. In each case, the prior art seeks to deploy stators whose gentle tapers relieve thermal stress (or accommodate bending) while still maintaining rotor/stator contact (albeit a relaxed contact) by virtue of the gentle taper on the rotor. The tapered stator designs described in this disclosure go in the opposite direction. Aggressive tapers are provided, particularly near the outlet end, and are engineered to intentionally separate local rotor lobes from stator lobes and thereby reduce the potential for high friction contact and rubber damage due to rotor tilt. The rotor is thus stabilized. Local rubber stress concentrations are relieved. It is acknowledged that in some deployments with aggressive tapers, a drop in power may result by opening up progressing cavities to reduce frictional contact between rotor lobes and stator lobes. Experimental data has shown that such a drop in power does not occur in all deployments. When a drop in power does occur, however, such a drop is considered an acceptable trade-off in view of the corresponding beneficial results of: (1) stabilizing the rotor, (2) reducing local rubber stresses, and (3) maintaining torque.

The foregoing has rather broadly outlined some features and technical advantages of the disclosed PDM power section technology, in order that the following detailed description may be better understood. Additional features and advantages of the disclosed technology may be described. It should be appreciated by those skilled in the art that the conception and the specific embodiments disclosed may be readily utilized as a basis for modifying or designing other structures for carrying out the same inventive purposes of the disclosed technology, and that these equivalent constructions do not depart from the spirit and scope of the technology as described.

BRIEF DESCRIPTION OF THE DRAWINGS

For a more complete understanding of embodiments described in detail below, and the advantages thereof, reference is now made to the following drawings, in which:

FIGS. 11A and 11B illustrate testing protocols undertaken to measure the effects of rotor tilt on power section performance, in which FIG. 11A illustrates test stand 100 and FIG. 11B illustrates linear position transducer assemblies 107, 108;

DETAILED DESCRIPTION

The following description of embodiments provides non-limiting representative examples using Figures, diagrams, graphs, plots, schematics, flow charts, etc. with part numbers and other notation to describe features and teachings of different aspects of the disclosed technology in more detail. The embodiments described should be recognized as capable of implementation separately, or in combination, with other embodiments from the description of the embodiments. A person of ordinary skill in the art reviewing the description of embodiments will be capable of learning and understanding the different described aspects of the technology. The description of embodiments should facilitate understanding of the technology to such an extent that other implementations and embodiments, although not specifically covered but within the understanding of a person of skill in the art having read the description of embodiments, would be understood to be consistent with an application of the disclosed technology.

Reference is now made to FIGS. 2A through 15B in describing currently preferred power section embodiments including tapered stators for remediating rotor tilt. For the purposes of the following disclosure, FIGS. 2A through 15B should be viewed together. Any part, item, or feature that is identified by part number on one of FIGS. 2A through 15B will have the same part number when illustrated on another of FIGS. 2A through 15B. It will be understood that the embodiments as illustrated and described with respect to FIGS. 2A through 15B are exemplary. The scope of the inventive material set forth in this disclosure is not limited to embodiments illustrated and described herein, or to other specific deployments thereof.

Finite Element Analysis

Figure 1:
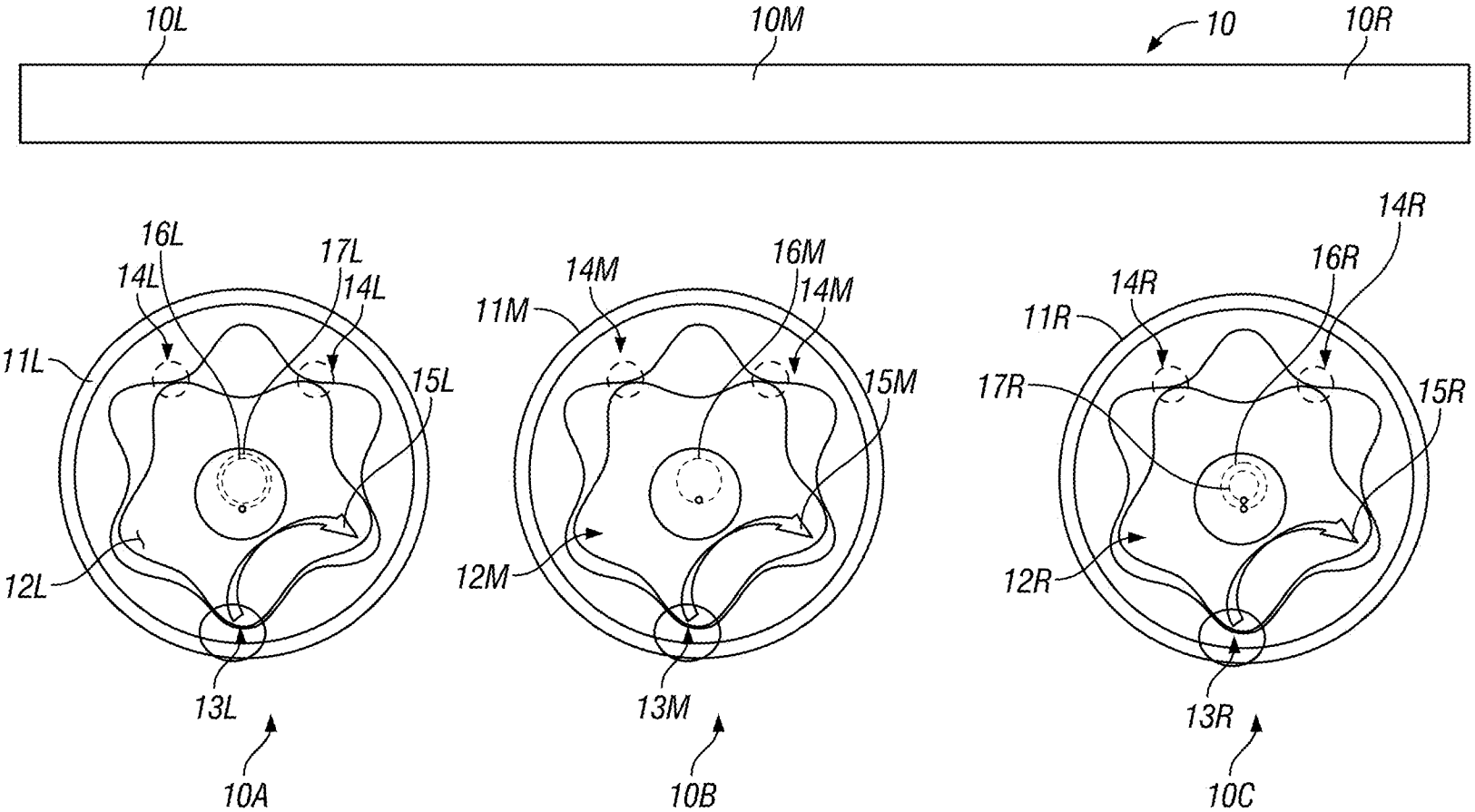
FIG. 1 is a schematic illustration of rotor behaviors on a continuum 10 of eccentric displacement of the rotor from its normal rotation orbit.
Figure 2A:
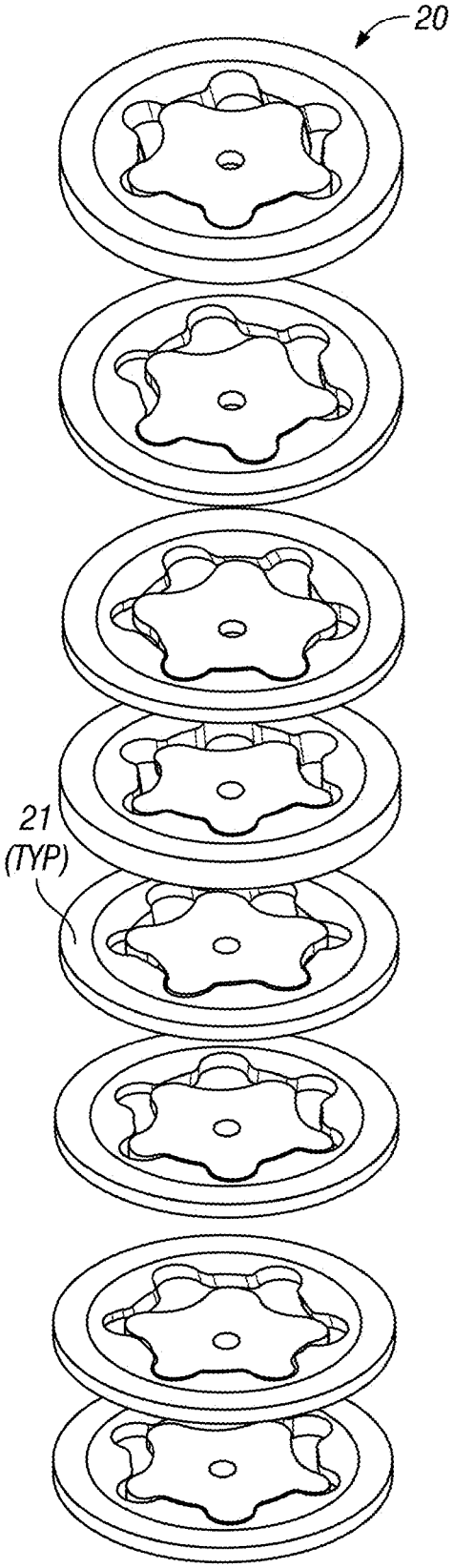
FIG. 2A depicts a series of exemplary cross-section slices 21 of a power section 20 on which FEA is performed.

FIGS. 2A through 4B describe the results of finite element analysis (FEA) examining the effect of rotor tilt on a hypothetical power section. FIG. 2A depicts a series of exemplary cross-section slices 21 of a power section 20 on which FEA is performed to determine the rotor's normalized eccentric orbital displacement along the PDM's length when subjected to rotor tilt forces expected in a high fluid pressure leaky PDM with linear pressure drop applied. The eccentric orbital displacement is thus configured to simulate expected rotor tilt in a high power PDM.

Figure 2B:
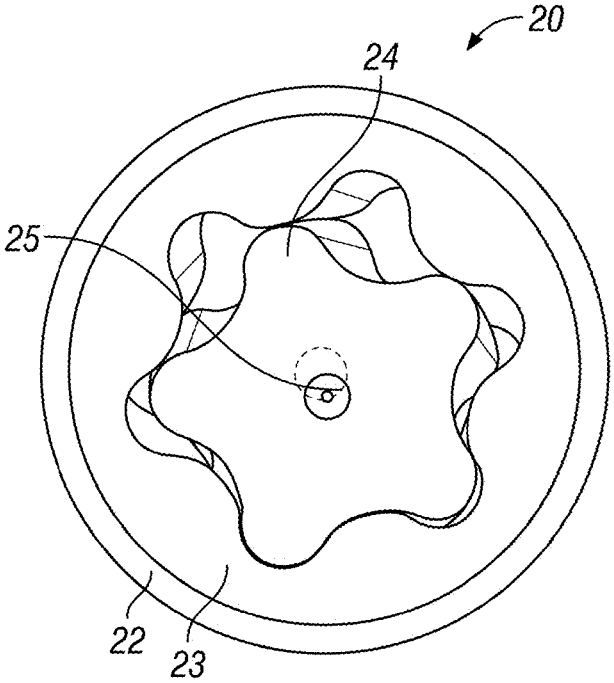
FIG. 2B depicts the model derived from FIG. 2A.

FIG. 2B shows the model derived from FIG. 2A. FIG. 2B illustrates power section 20 including stator tube 22, stator elastomer 23, rotor 24, and nominal (design) orbit of rotation of rotor center 25.

Figure 3:
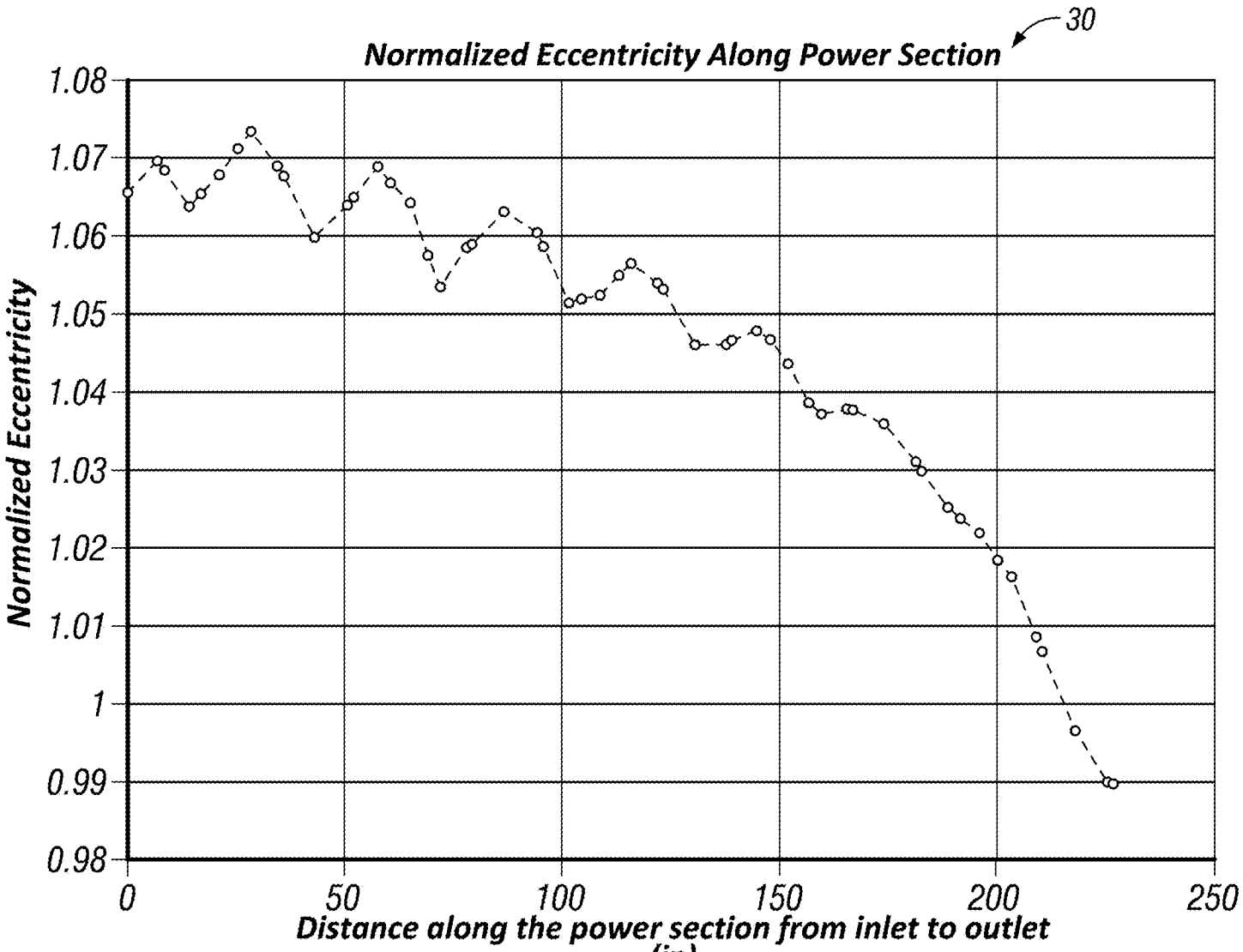
FIG. 3 is a plot 30 from FEA of normalized rotor eccentricity vs. position along PDM length.

FIG. 3 a plot of the normalized position of the rotor's center under load versus its respective position along the power section from inlet to outlet. FIG. 3 is a predictive plot from FEA work on the model of FIGS. 2A and 2B. As used in this disclosure, the terms "normalized position of the rotor's centerline", or the "normalized eccentricity" of the rotor, refer to correcting the rotor position in FEA for small deflections of the stator tube in the FEA model. The FEA model was not characterized for an infinitely stiff stator tube. Correction, or "normalizing", of the rotor position (eccentricity) was required in order to remove the effect of small stator tube deflections on the rotor position inherent in applying FEA forces to an overall power section model. The x-axis on plot 30 on FIG. 3 shows the position along the length of the power section. The scale represents a theoretical power section length in inches. Zero is at the inlet. The y-axis shows the normalized eccentricity of the rotor's center. FIG. 3 illustrates that the tilting slope in about the last 80" (34%) of the entire 235" profile is much steeper than in about the first 155". Further, about the last 10"-35" (4%-15%) of this exemplary power section design has a much steeper tilting slope than the rest of the length. FIG. 3 validates that rotor tilt is most prevalent in a zone near the outlet (bottom end near the bit) where local fluid pressure imbalances are forcing the interference fits between rotor and stator lobes on the non-eccentric side to engage heavily.

Figure 12A:
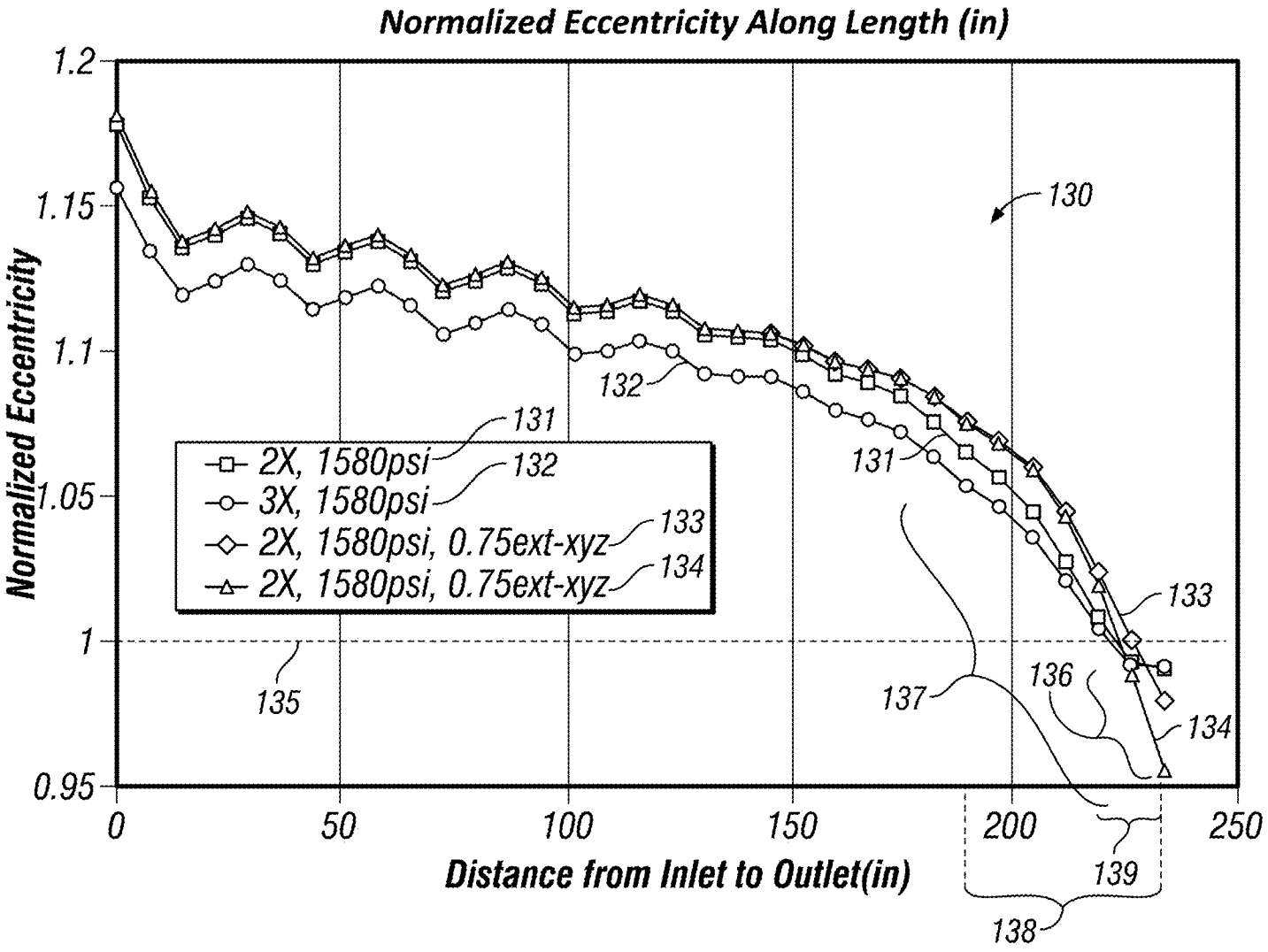
FIGS. 12A and 12B illustrate aspects of a further FEA plot 130 depicting normalized rotor eccentricity vs. position along PDM length.
Figure 12B:
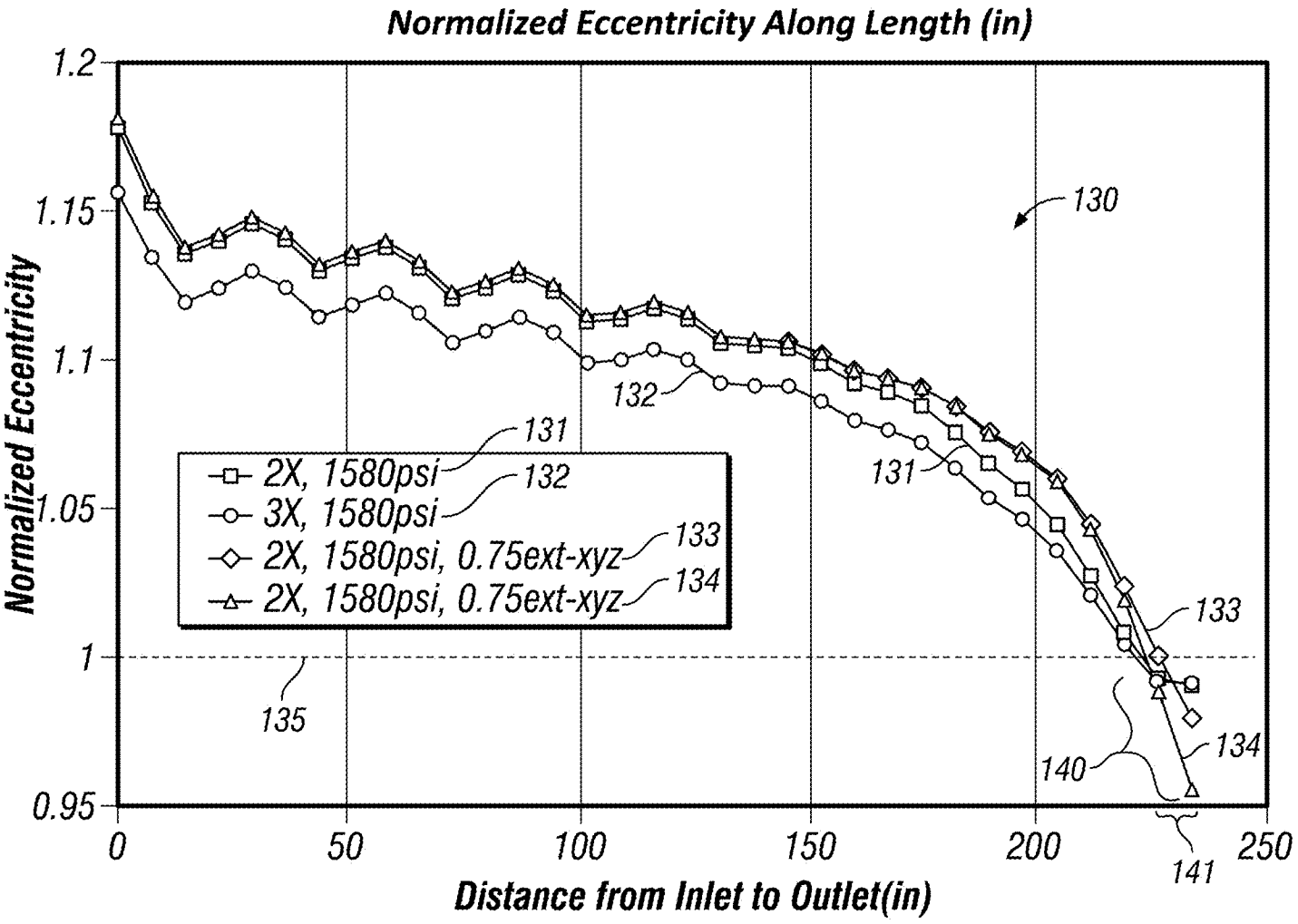
Figure 13:
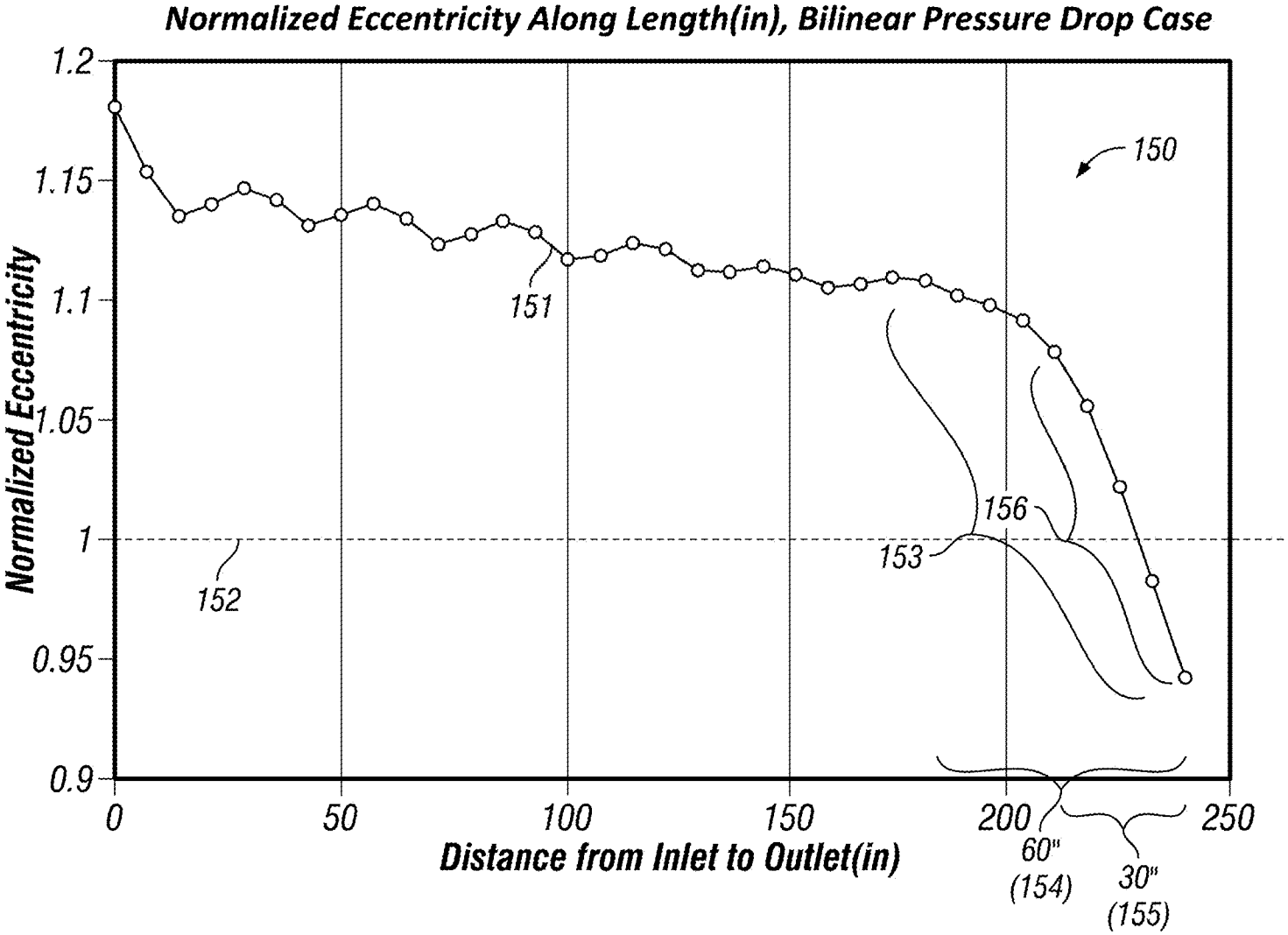
FIG. 13 is a yet further FEA plot 150 depicting normalized rotor eccentricity vs. position along PDM length.

FIGS. 12A, 12B and 13 are similar predictive FEA plots to FIG. 3, again depicting FEA work on the model of FIGS. 2A and 2B. As such, FIGS. 12A and 12B illustrate aspects of a further FEA plot 130 depicting normalized rotor eccentricity (y-axis) vs. position along PDM length from inlet to outlet in inches (x-axis). FIG. 13 illustrates aspects of a yet further FEA plot 150 depicting normalized rotor eccentricity vs. position along PDM length.

FIGS. 12A and 12B should be viewed together. FEA plot 130 on FIGS. 12A and 12B represents a more idealized version of FIG. 3. The transmission was characterized to be stiffer in FIG. 3 for FEA purposes. FIGS. 12A and 12B (plot 130) simulate rotor behavior with a less stiff transmission that is more likely to reflect actual downhole conditions. Two hard (stiff) rubber types were simulated on FIGS. 12A and 12B, plotted with different simulated pressure drops to assess corresponding rotor deflection behavior. Lines 131-134 on FIGS. 12A and 12B correspond to the various rubber stiffness/pressure drop plots. The legend on FIGS. 12A and 12B may be "decoded" as follows: 2× or 3× is a rubber stiffness parameter; 1580 psi is a pressure drop parameter; and 0.75 ext-xyz" etc. correspond to non-linear pressure drop functions. To summarize, the legend on FIGS. 12A and 12B corresponds to Table 1 below:

TABLE 1

| Legend | Line number | Description |
|---|---|---|
| 2x, 1580 psi | 131 | Stiff rubber, linear pressure drop |
| 3x, 1580 psi | 132 | Very stiff rubber, linear pressure drop |
| 2x, 1580 psi, 0.75 ext-xyz | 133 | Stiff rubber, non-linear pressure drop A |
| 2x, 1580 psi, 0.75 ext-xyz | 134 | Stiff rubber, non-linear pressure drop B |

Plot 130 on FIGS. 12A and 12B reveals several aspects of rotor behavior worthy of note. Brackets 139 and 138 on FIG. 12A highlight the last (bottom end) 12 inches and 50 inches of the power section respectively, which correspond to about the last 0.2 to 1.5 stage lengths at the bottom end. Brackets 137 and 136 on FIG. 12A indicate that undesirable bend behavior happens near the bottom end, with normalized eccentricity (y-axis) falling sharply in the last 0.2 to 1.5 stage lengths of the rotor. Rotor tilt would be evident in this region, binding the rotor against stator lobe tips and increasing friction at interference fits. Further, referring to reference line 135 on both FIGS. 12A and 12B, highly undesirable behavior happens when normalized rotor eccentricity falls below 1.0. Normalized rotor eccentricity of 1.0 is the nominal design orbit where rotor lobes contact stator lobe tips as designed, usually with an interference fit. Normalized rotor eccentricity below 1.0 suggests that the rotor is binding heavily against the stator lobe tips, causing high friction and shear stress in the stator lobes. Such highly undesirable behavior below a normalized rotor eccentricity of 1.0 is further illustrated by brackets 140 and 141 on FIG. 12B where approximately the last 6 inches to 8 inches of power section length is below the threshold and would be severely affected by rotor tilt.

FIGS. 12A and 12B further demonstrate that rotor tilt behavior is substantially unaffected by variations in rubber stiffness and pressure drops. With small differences, lines 113-134 on FIGS. 12A and 12B all show overall generally similar rotor behavior as rubber stiffness and pressure drop varies.

FIG. 13 illustrates aspects of a yet further FEA plot 150 depicting normalized rotor eccentricity (y-axis) vs. position along PDM length from inlet to outlet in inches (x-axis). FIG. 13 differs from previous FEA plots in that the model was characterized with a more aggressive pressure drop in order to simulate performance at or near the power section's operating limit (or at stall conditions). Similar to plot 130 on FIGS. 12A and 12B, plot 150 on FIG. 13 depicts rotor behavior (line 151) in a power section with a nominal stator pitch of 33.5 inches. In comparison to FIGS. 12A and 12B, plot 150 on FIG. 13 shows that undesirable rotor tilt behavior happens further from the outlet of the power section as a result of the more aggressive pressure drop. Brackets 155 and 154 on FIG. 13 highlight the last (bottom end) 30 inches and 64 inches of the power section respectively, and brackets 153 and 156 indicate the sharp fall in normalized rotor eccentricity in those regions. Further, and similar to plot 130 on FIGS. 12A and 12B, reference line 152 on FIG. 13 denotes that highly undesirable behavior happens when normalized rotor eccentricity falls below 1.0.

Figure 4A:
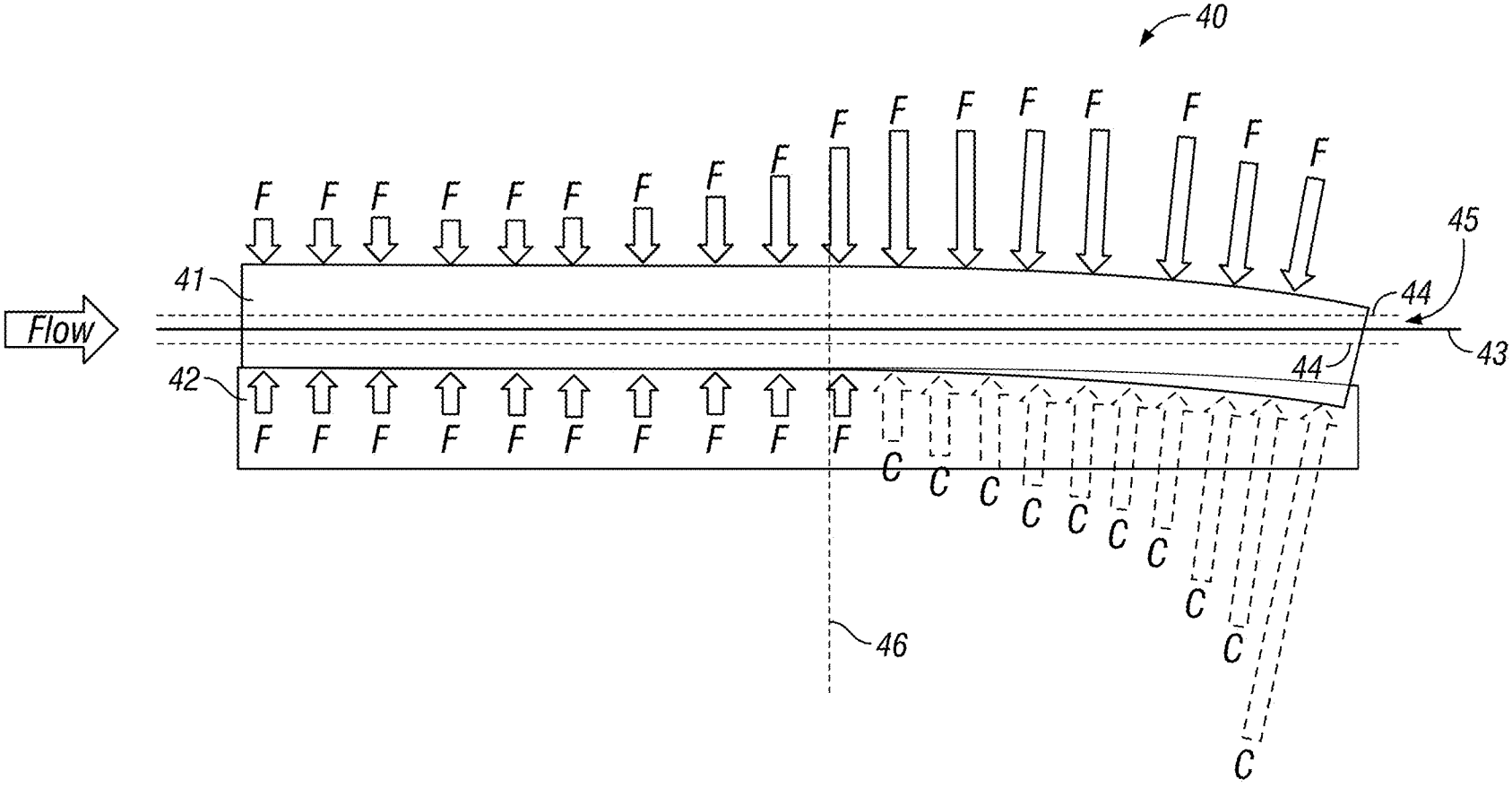
FIG. 4A (Prior Art)
FIGS. 4A and 4B are schematic illustrations depicting contact pressure distributions from rotor tilt in a standard PDM power section 40 (FIG. 4A) and in a power section with remediating taper 50 (FIG. 4B)
Figure 4B:
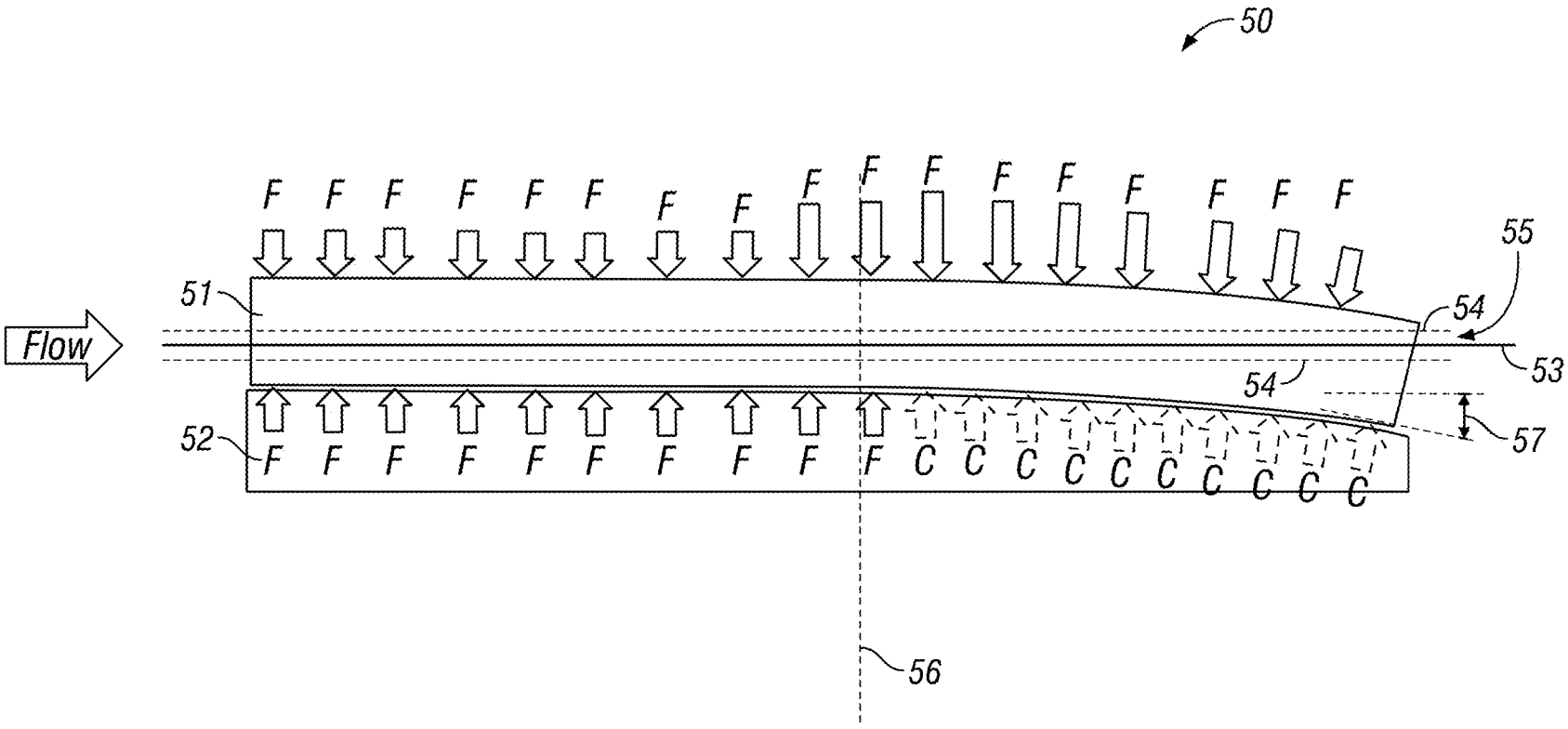

FIGS. 4A and 4B are schematic illustrations depicting contact pressure distributions from rotor tilt in a standard PDM power section 40 (FIG. 4A) and in a power section with remediating taper 50 (FIG. 4B). FIG. 4A illustrates the rotor tilt effect shown in FIG. 3. FIG. 4B illustrates conceptually the proposed remediation of the rotor tilt effect shown on FIG. 4A using stators with strategically-located engineered tapers.

Each of FIGS. 4A and 4B show schematically the following common features:

Rotor 41, 51;

Stator 42, 52;

Nominal rotor centerline 43, 53;

Nominal rotor orbit of rotation 44, 54;

Nominal rotor eccentricity 45, 55; and

Plane of last fully-sealed stage 46, 56.

Referring first to FIG. 4A, fluid pressure force vectors F exert an increasing force on rotor 41 into stator 42 in standard power section 40. Reactionary contact pressure force vectors C increase correspondingly in stator 42, causing friction buildup in stator 42. FIG. 4A further depicts rotor tilt, particularly downhole of the plane of the last fully-sealed stage 46.

In contrast to stator 42 on FIG. 4A, power section 50 on FIG. 4B provides stator 52 with an engineered taper 57 to remediate the rotor tilt seen on FIG. 4A. Fluid pressure force vectors F on FIG. 4B are reduced on rotor 51, which effect in turn reduces reactionary contact pressure force vectors C in stator 52. The effect of taper 57 on FIG. 4B is thus to stabilize rotor 51 and normalize contact pressure between the rotor 51 and stator 52.

Disclosed Embodiments within the Scope of this Disclosure

It will be understood that the various embodiments set forth in this disclosure are exemplary only, and do not limit the full scope of this disclosure. As noted above, this disclosure addresses the rotor tilt problem by providing a tapered stator that preferably includes an aggressive taper near the outlet end of the PDM. Contrary to some of the teachings of the prior art, this disclosure seeks to remediate rotor tilt generally with a tapered stator whose tapered geometry is selected to intentionally separate the rotor from the stator to relieve contact pressure (and associated friction and tear stress) between rotor and stator. This disclosure particularly seeks to intentionally taper the stator aggressively in a region near the outlet where the rotor tilt is particularly problematic. In some embodiments, the taper near the outlet provides a clearance fit rather than an interference fit with the rotor. In preferred embodiments, the clearance fit is much larger than seen or expected in the prior art.

It is acknowledged that this solution will likely sacrifice power output of the PDM by creating intentional leaks at the rotor/stator contact. However, the rotor remains stable in its rotation. Rubber stress concentrations are relieved. Power transfer and rotor stability is optimized in hard rubber stator embodiments, especially at high fluid pressure.

As noted, this disclosure describes tapers designed to offer clearance fits where rotor tilt is expected. In particular, this disclosure favors aggressive tapers with high clearance fits at the outlet end of the PDM where rotor tilt forces are also expected to be especially high. These designs are not suggested by the prior art. The prior art is primarily concerned with thermal expansion. The prior art discusses gentle tapers that will loosen interference fit but will nonetheless keep leakage to a minimum in order to maintain power. Some prior art references teach keeping rotor/stator contact with looser fits to accommodate thermal expansion. In direct contrast, this disclosure describes solutions for rotor tilt in which the stator is intentionally separated from contact with the rotor in order to controllably stabilize local fluid pressure and normalize rotor/stator contact pressure.

Figure 6A:
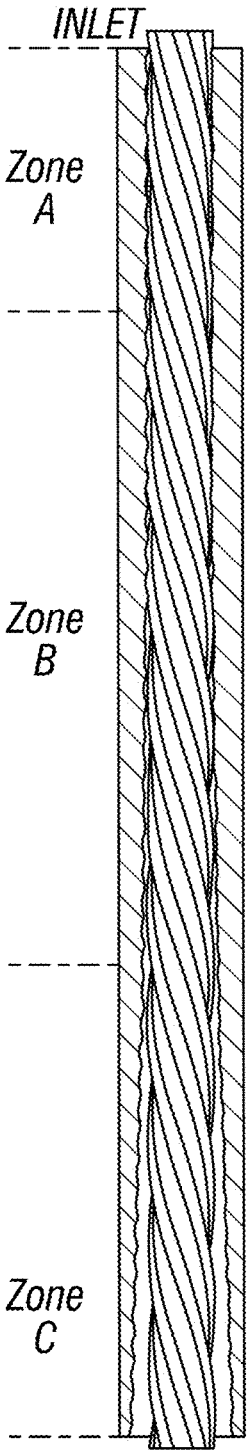
FIGS. 6A and 6B are longitudinal representations of a PDM power section with a 2-stage tapered stator deployed to compensate for rotor tilt, in which FIG. 6B has its scale exaggerated to emphasize relevant aspects.
Figure 6B:
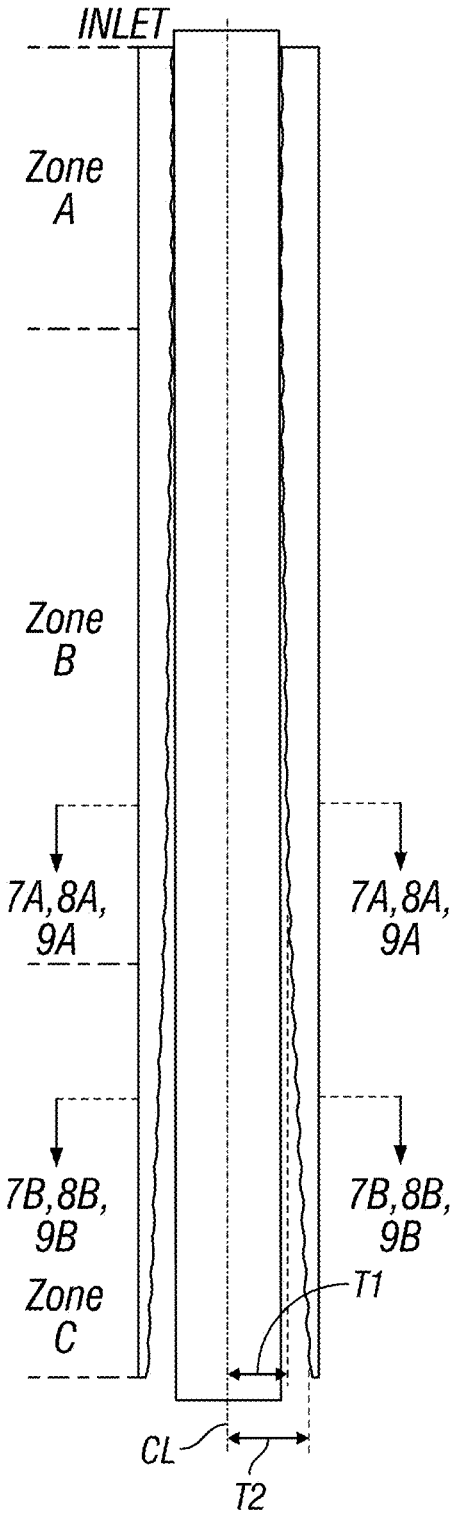

Preferred embodiments of tapered stators per this disclosure provide a 2-stage taper to remediate rotor tilt. The scope of this disclosure is not limited to 2-stage tapers, however. FIGS. 6A and 6B are longitudinal representations of a preferred PDM power section embodiment with such a 2-stage tapered stator. The scale in FIG. 6B has been exaggerated in order to illustrate relevant aspects better. FIG. 6A is more to scale. FIG. 6A is primarily for orientation of FIG. 6B with its exaggerated scale. FIG. 6B depicts an untapered Zone A near the inlet. A first taper T1 is shown in Zone B on FIG. 6B. First taper T1 is less aggressive and functions primarily to accommodate thermal expansion and some rotor tilt. A second taper T2 is shown in Zone C on FIG. 6B. Second taper T2 is more aggressive than first taper T1, and functions primarily in Zone C to stabilize local fluid pressure and normalize rotor/stator contact pressure.

The rotor is shown in a neutral position on FIGS. 6A and 6B. It will be appreciated that the purpose of FIGS. 6A and 6B is primarily to illustrate schematically the 2-stage taper on the stator. The rotor is shown in a neutral position because its actual position will vary according to the specific 2-stage taper embodiment deployed within the more general scope of FIG. 6B.

Tapers T1 and T2 on FIGS. 6A and 6B are illustrated as linear. It will nonetheless be appreciated that the scope of this disclosure is not limited to linear tapers. Other embodiments may provide arcuate, geometric or logarithmic profiles, for example.

In some embodiments, about 50% of the PDM's initial length from the inlet is untapered. The first taper stage of the 2-stage taper begins at about the halfway point of the PDM's length from the inlet towards the outlet. "About halfway" is selected in these embodiments because the maximum power output of a multistage power section can best be obtained by utilizing a single inference fit for at least 50% of the inlet side. A transition between the untapered portion and the first taper stage is desirable.

The first taper stage may transition into the second taper stage at a point anywhere up to about 90% of the PDM's length from inlet to outlet. The second (and more aggressive) taper stage preferably begins at a point along the PDM's length in a range from about 10% length to about 50% length from the outlet. A taper fit of about 102% to about 120% of paradigm design eccentricity is desirable at the outlet. Stated differently, and with reference to description of FIG. 10A below, taper embodiments may preferably include a taper defined by:

Stator minor diameter+[about (0.05×eccentricity of design) to about (0.2×eccentricity of design)]

"Eccentricity of design" refers to the radius of the expected (design) orbital pathway of the center of the rotor absent any rotor tilt and in an untapered stator. The first and second tapers may be engineered back from such taper fit at the outlet. A transition between the first taper stage and the second taper stage is desirable.

In other embodiments, rotor tilt may be remediated according to this disclosure by a power section whose stator minor diameter at outlet is larger than the nominal inlet diameter and is tapered back to the nominal (inlet) minor diameter over a length spanning the outlet to about the midpoint of the power section. In some embodiments, the stator minor diameter at outlet may be larger than the nominal inlet diameter by at least about 5% of the eccentricity (0.5×stator lobe height). In some embodiments, the stator minor diameter at outlet is larger than the nominal inlet diameter and is tapered back to the nominal (inlet) minor diameter over a length spanning the outlet to about 25% of power section length back from outlet. In some embodiments, the stator minor diameter at outlet is larger than the nominal inlet diameter and is tapered back to the nominal (inlet) minor diameter over a length spanning the outlet to about 10% of power section length back from outlet. In some embodiments, the stator minor diameter at outlet is larger than the nominal inlet diameter and is tapered back to the nominal (inlet) with more than one taper where the most aggressive taper occurs in about the last 5% of PDM length measured from outlet, or alternatively in about the last 10% of PDM length measured from outlet, or alternatively in about the last 25% of PDM length measured from outlet, or alternatively in about the last 50% of PDM length measured from outlet.

In other embodiments, stator tapers may be further compensated for expected thermal expansion in a conventional cylindrical fit. In such embodiments, tapers may be first designed to remediate rotor tilt, and then adjusted further for expected thermal expansion by removing additional material from stator lobes. In some such embodiments, at least an additional 0.015 inches of stator lobe material may preferably be removed in popular sized PDMs.

A further exemplary embodiment of a 2-stage tapered stator within the scope of this disclosure may be derived with reference to FIG. 3. It will be recalled from prior description that FIG. 3 is an FEA-based plot of the normalized position of the FEA rotor's center versus its respective position along the power section from inlet to outlet. FIG. 3 illustrates that the tilting slope in about the last 80" (34%) of the entire 235" profile contour length is much steeper than in about the first 155". Further, about the last 10"-35" (4%-15%) of this exemplary power section design has a much steeper tilting slope than the rest of the length. An exemplary design to remediate the rotor tilt shown on FIG. 3 might provide two different stator tapers corresponding to the different tilts observed. Working back from the outlet, the stator might provide an aggressive taper on the final 30"-35" of the stator's length. The stator may then provide a less aggressive taper in the region from about 30"-35" back from the outlet to about 80" back from the outlet. The taper slope in the 30"-80" region might be about 0.25 to about 0.5 of the taper slope in the 0"-30" region. When the tapered fit is optimized, the eccentricity of the tapered regions better match the eccentricity of the deflected rotor at maximum power and stall conditions.

In some embodiments, the stator taper may be deployed based on an average of major and minor diameters. Conventional stator geometry and nomenclature acknowledges that a conventional stator has a length L between stator inlet and stator outlet, wherein Zn represents a stator position along L. The conventional stator further provides an internal surface with lobes formed in the internal surface, wherein the lobes define helical pathways in the stator internal surface. Zeniths of the lobes at stator position Zn define a stator internal minor diameter DMINn, and nadirs of the pathways at stator position Zn define a stator internal major diameter DMAJn, wherein (DMINn+DMAJn)/2 further defines a stator average diameter DAVEn at Zn. In embodiments deploying the taper based on an average of major and minor diameters, the taper may commence at stator position Z1 at about 0.67 L measured from the stator inlet, and the taper may end at stator position Z3 at 1.0 L measured from the stator inlet, in which DAVE3≥DAVE1+(0.03×(DMAJ1−DMIN1)/2). In other embodiments deploying the taper based on an average of major and minor diameters, the taper may provide a transition between stator position Z1 and stator position Z2, in which Z2 is at about 0.77 L as measured from the stator inlet, and in which DAVE2≥DAVE1+(0.015×(DMAJ1−DMIN1)/2).

Preferred embodiments within the scope of this disclosure deploy the taper on the minor diameter of the stator. The minor diameter taper is contrary to the teachings of the prior art. The prior art is concerned with thermal expansion and/or bending in power sections, where a minor diameter taper would likely not be suitable to maintain a desired but relaxed rotor/stator contact.

Figure 7A:
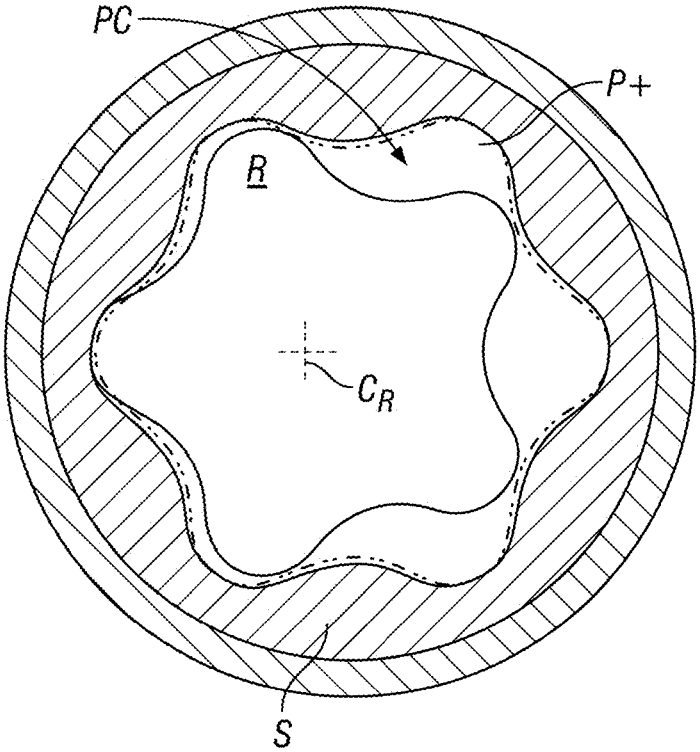
FIGS. 7A and 7B are sections as shown on 6B in which stator has taper deployed on the minor diameter only.
Figure 7B:
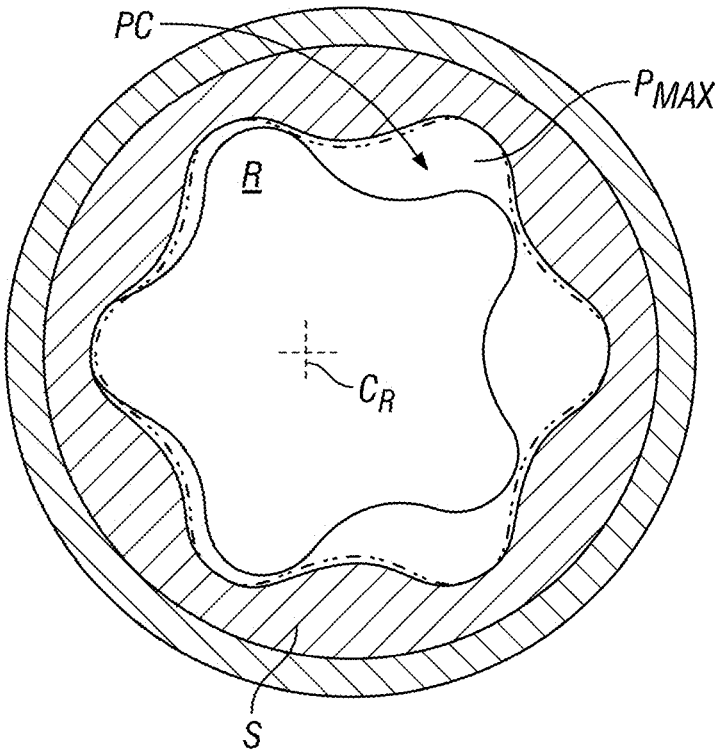
Figure 8A:
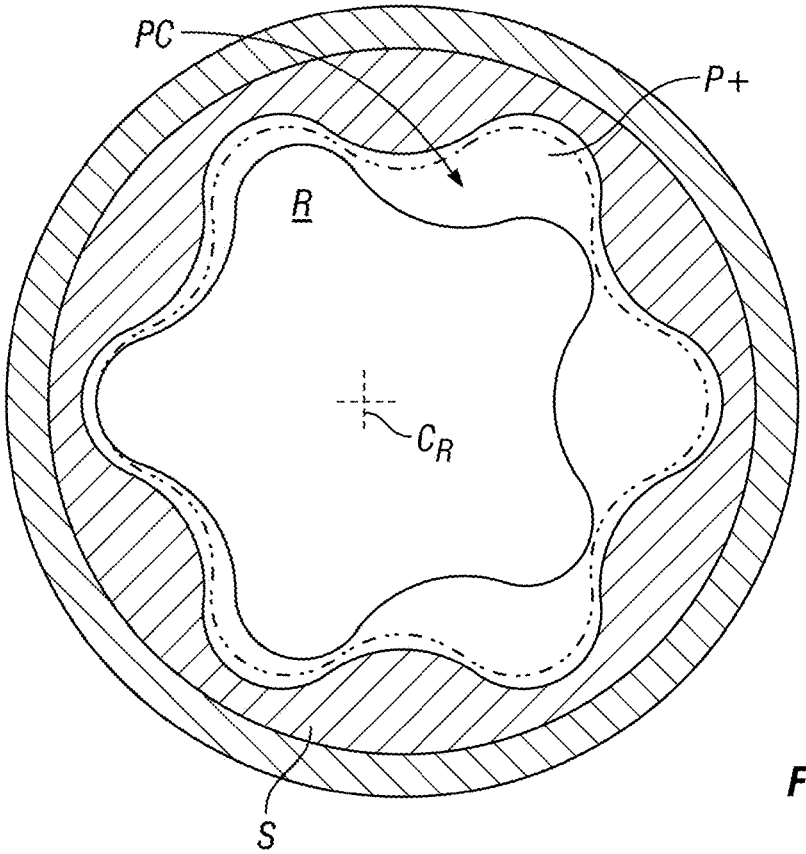
FIGS. 8A and 8B are sections as shown on 6B in which stator has taper deployed on both major and minor diameters.
Figure 8B:
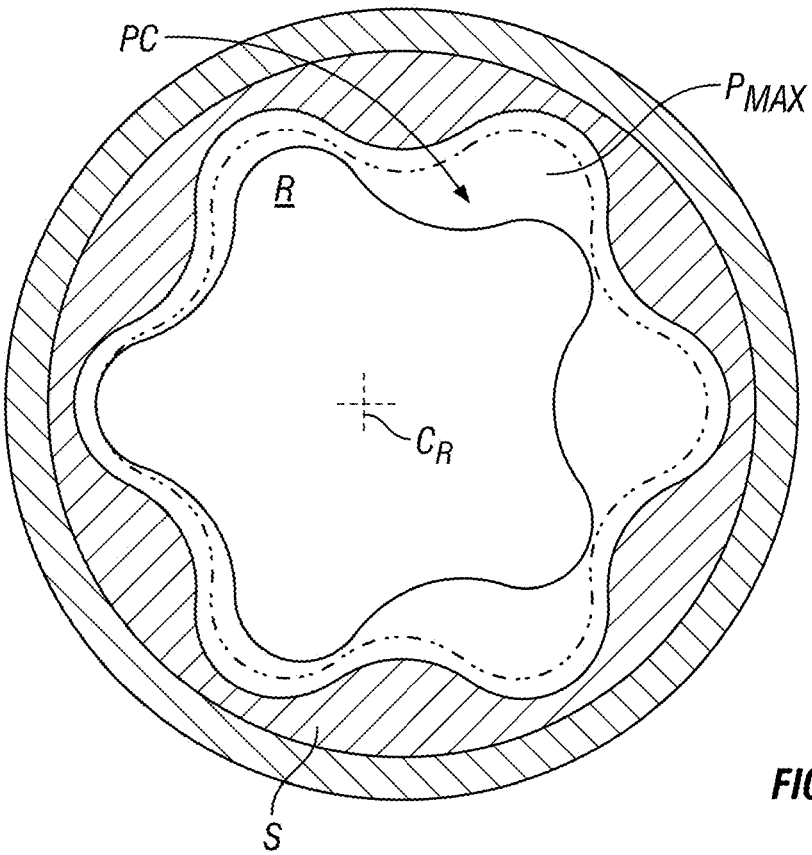
Figure 9A:
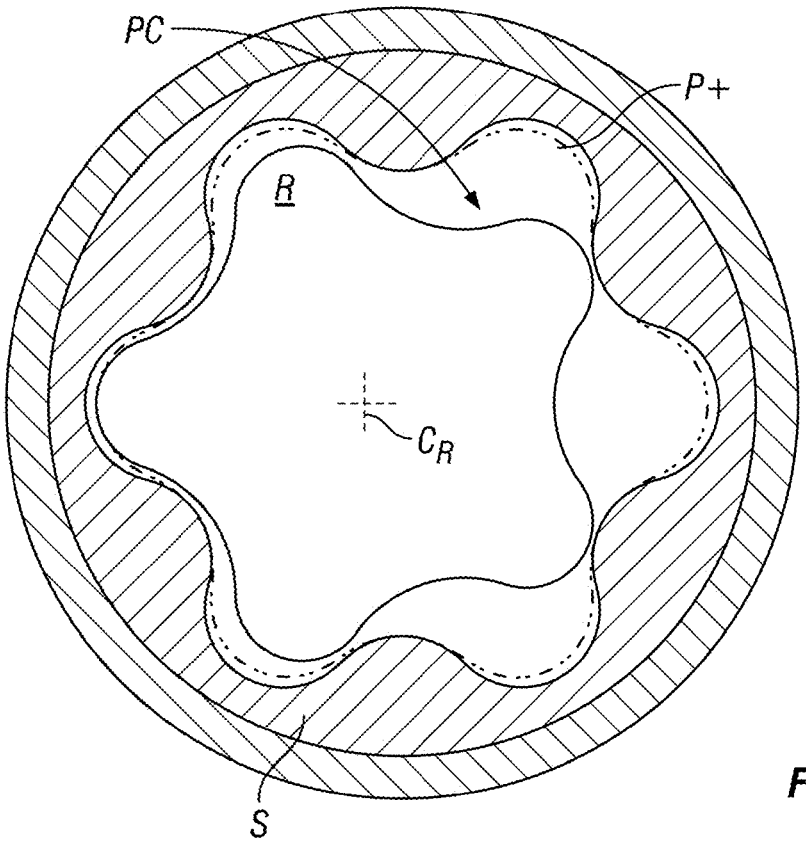
FIGS. 9A and 9B are sections as shown on 6B in which stator has taper deployed on major diameter only.
Figure 9B:
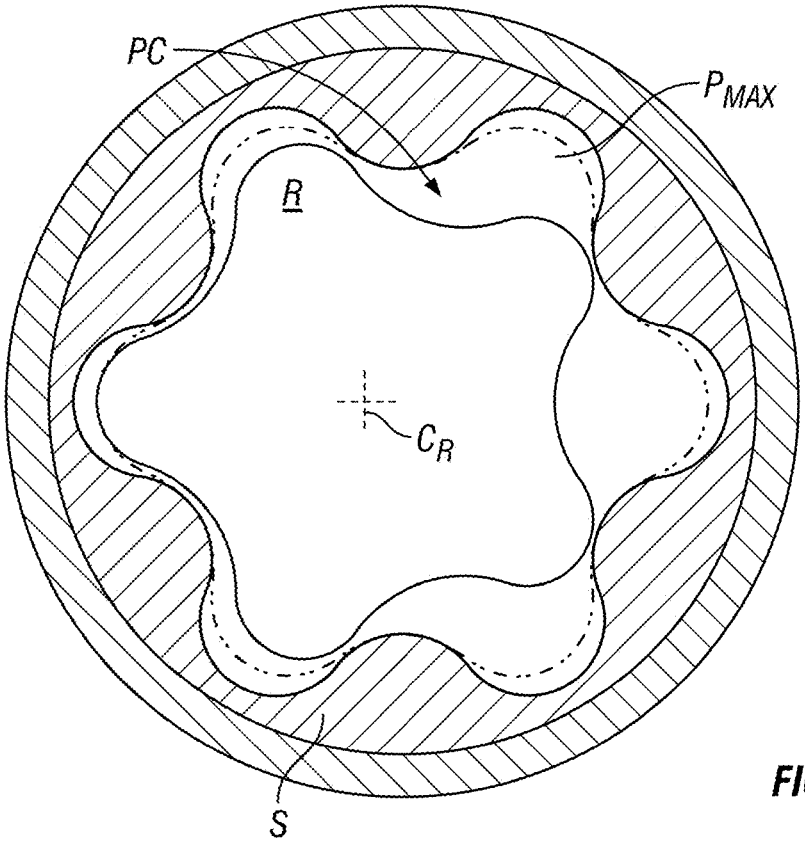

FIGS. 7A and 7B are sections as shown on FIG. 6B in embodiments in which tapers T1 and T2 on FIG. 6B are deployed on the stator minor diameter only (see broken lines at stator minor diameters on FIGS. 7A and 7B denoting taper). FIGS. 8A and 8B are sections as shown on FIG. 6B in embodiments in which tapers T1 and T2 on FIG. 6B are deployed on both the stator major and minor diameters (see broken lines at stator major and minor diameters on FIGS. 8A and 8B denoting taper). FIGS. 9A and 9B are sections as shown on FIG. 6B in embodiments in which tapers T1 and T2 on FIG. 6B are deployed on the major diameter only (see broken lines at stator major diameters on FIGS. 9A and 9B denoting taper). Tapers as illustrated on FIGS. 7A through 9B are all embodiments within the scope of this disclosure, although minor diameter tapering per FIGS. 7A and 7B are currently preferred embodiments. FIGS. 7A through 9B have the following common features: Rotor R; stator S; center of rotor $C_R$; progressing cavity PC; elevated fluid pressure P+; and maximum fluid pressure $P_{MAX}$.

Figure 10A:
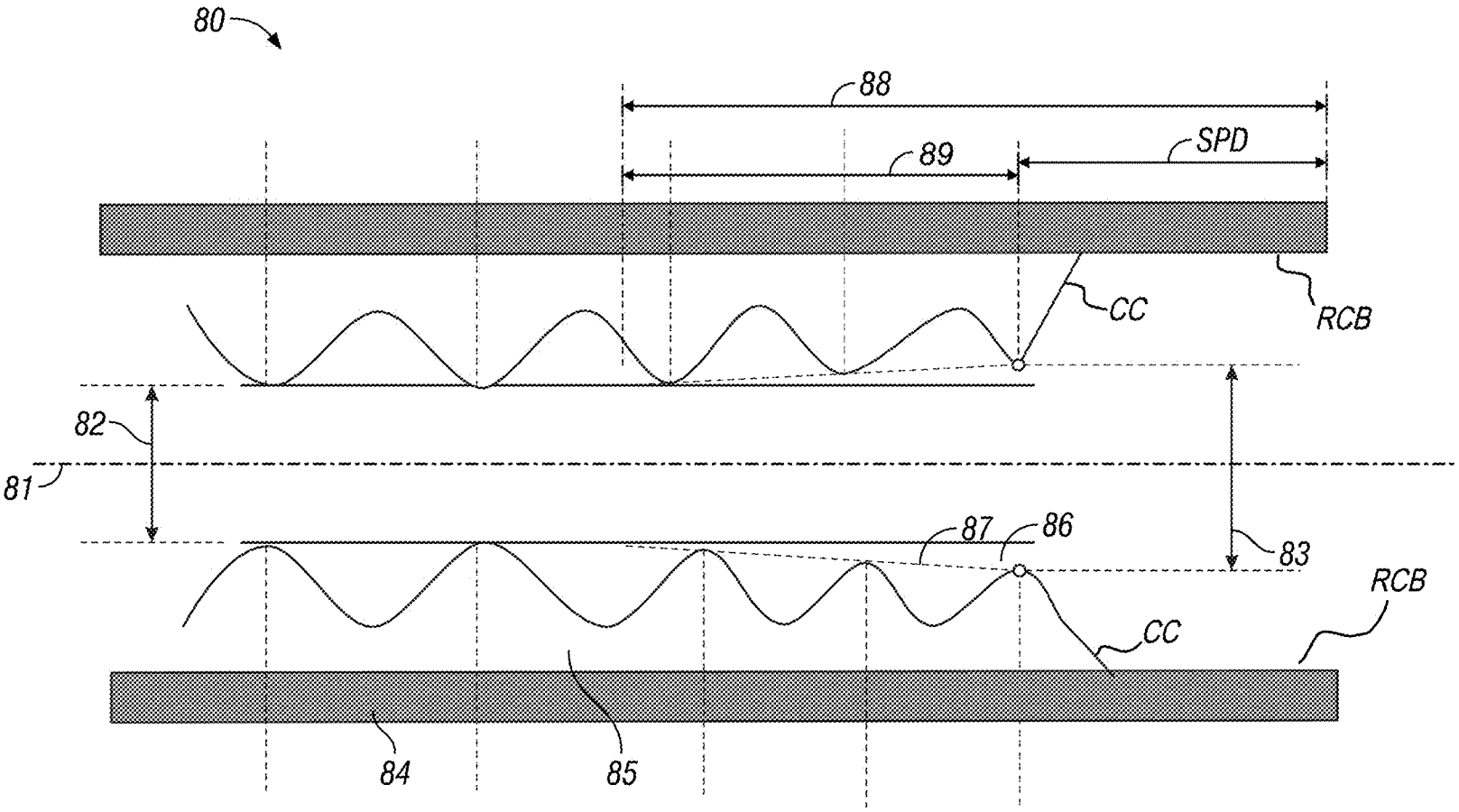
FIGS. 10A and 10B are schematic illustrations depicting more specific embodiments of tapered stators more generally described with reference to FIGS. 6A and 6B.
Figure 10B:
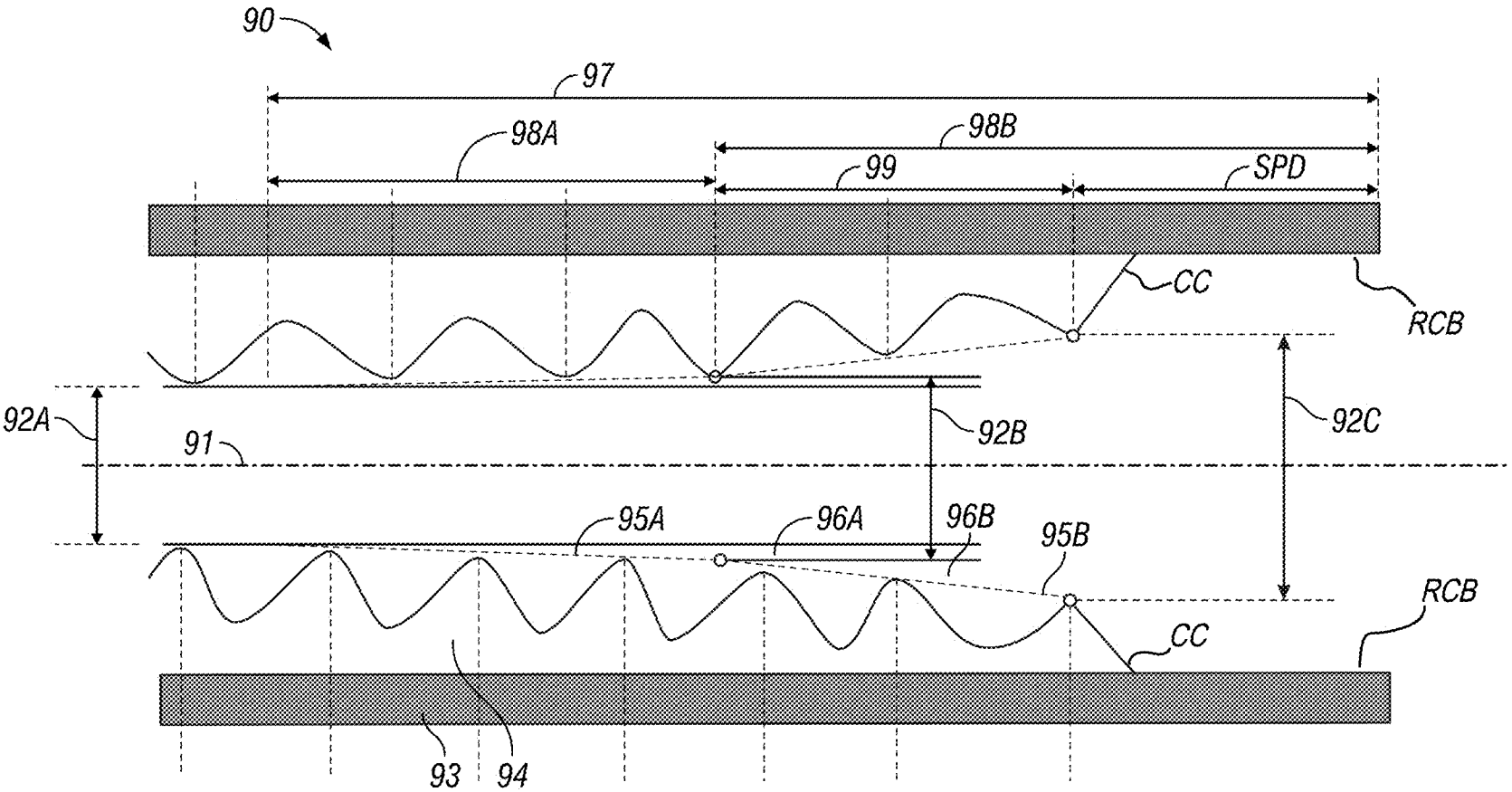

FIGS. 10A and 10B are schematic illustrations depicting more specific embodiments of tapered stators more generally described above with reference to FIGS. 6A and 6B. FIG. 10A illustrates schematically a more specific stator embodiment 80 with a single bottom end taper 86, 87. Taper 86, 87 is analogous to taper T2 by itself on FIG. 6B. As is preferred herein, taper 86, 87 on stator embodiment 80 on FIG. 10A is on stator minor diameter 82 only. Stator embodiment 80 also includes stator centerline 81, exit diameter 83, stator tube 84 and stator elastomer 85. The geometry of taper 86, 87 on FIG. 10A includes a first relief depth 88, a first relief length 89 and a stator relief depth SPD.

Exemplary embodiments according to FIG. 10A may be characterized from among the following:

- Preferred—Exit diameter 83≥Minor diameter 82+about (0.05×eccentricity of design)
- More preferred—Exit diameter 83≥Minor diameter 82+about (0.1×eccentricity of design)
- Preferred for aggressive drilling—Exit diameter 83≥Minor diameter 82+about (0.15×eccentricity of design)

Preferred—First relief length 89≥about 0.1×Stator pitch length, but ≤about 2.0×Stator pitch length More preferred—First relief length 89≥about 0.2×Stator pitch length, but ≤about 1.5×Stator pitch length Most preferred—First relief length 89≥about 0.5×Stator pitch length, but ≤about 1.0×Stator pitch length The term "eccentricity of design" as used above refers to the radius of the expected (design) orbital pathway of the center of the rotor absent any rotor tilt and in an untapered stator.

FIG. 10B illustrates schematically a more specific stator embodiment 90 with a double bottom end taper 95A, 95B, 96A, 96B. Taper 95A, 95B, 96A, 96B is analogous to tapers T1 and T2 on FIG. 6B. As is preferred herein, taper 95A, 95B, 96A, 96B on stator embodiment 90 on FIG. 10B is on stator minor diameter 92A only. Stator embodiment 90 also includes stator centerline 91, second diameter 92B, exit diameter 92C, stator tube 93 and stator elastomer 94. The geometry of taper 95A, 95B, 96A, 96B on FIG. 10B includes a second relief depth 97, a second relief length 98A, a first relief depth 98B, a first relief length 99 and a stator relief depth SPD.

Exemplary embodiments according to FIG. 10B may be characterized from among the following:

Preferred—Exit diameter 92C≥Minor diameter 92A+about (0.05×eccentricity of design) AND Second diameter 92B≤Minor diameter 92A+about (0.025×eccentricity of design)

More preferred—Exit diameter 92C≥Minor diameter 92A+about (0.1×eccentricity of design) AND Second diameter 92B≤Minor diameter 92A+about (0.05×eccentricity of design)

Preferred—First relief length 99≥about 0.1×Stator pitch length, but ≤about 2.0×Stator pitch length, AND Second relief length 98A≥about 1.0×First relief length 99, but ≤about 2.0×First relief length 99

More preferred—First relief length 99≥about 0.2×Stator pitch length, but ≤about 1.5×Stator pitch length, AND Second relief length 98A≥about 1.0×First relief length 99, but ≤about 2.0×First relief length 99

Most preferred—First relief length 99≥about 0.5×Stator pitch length, but ≤about 1.0×Stator pitch length, AND Second relief length 98A≥about 1.0×First relief length 99, but ≤about 2.0×First relief length 99

As noted above, the term "eccentricity of design" as used above refers to the radius of the expected (design) orbital pathway of the center of the rotor absent any rotor tilt and in an untapered stator. Further, for additional clarification, FIGS. 10A and 10B illustrate cutback counterbores CC on stator elastomers 85, 94 and rubber cutbacks RCB on stator tubes 84, 93. Those of ordinary skill in this art will understand that the stator elastomer diameter enlargement reliefs disclosed and/or claimed in this application (such as tapers 86, 87 on FIGS. 10A and 95A, 95B, 96A, 96B on FIG. 10B) expressly exclude cutback counterbores CC on FIGS. 10A and 10B. Likewise, those of ordinary skill in this art will understand that the stator elastomer diameter enlargement reliefs disclosed and/or claimed in applications from which this application claims priority, or in applications that claim priority to this application, also expressly exclude cutback counterbores CC on FIGS. 10A and 10B. Those of ordinary skill will understand that a stator elastomer generally has two distinct surface features. There is the helical contour surface, which, in a power section, forms progressing cavities (or "pockets") via contact with a helical contour surface of a rotor. The stator elastomer's helical contour surface is functionally distinct from cutback counterbores formed at an end of the helical contour surface to provide a transition from the helical contour surface to the interior of the stator tube. Cutback counterbores CC such as shown on FIGS. 10A and 10B make no progressing cavity contact with a rotor in an operating power section and thus have no contribution to power section performance. Cutback counterbores CC are termination transition features of the stator elastomer, and are typically provided at both the inlet and outlet ends of the stator. Cutback counterbores CC are typically frustroconical in geometry, and typically provide a 45-degree chamfer transitioning the stator elastomer's helical contour surface to the inner surface of the stator tube in a controlled manner. Rubber cutbacks RCB are end portions of the inside of the stator tube leading to the inlet and outlet once the transition provided by the chamfer on cutback counterbores CC is complete. The purposes of cutback counterbores CC and rubber cutbacks RCB include (a) providing manufacturing control on the length of the helical contour surface of the stator, (b) providing a transition geometry that limits fluid erosion during power section operation, and (c) providing axial clearance for end portions of the rotor at inlet and outlet, where typically the exterior surface of the rotor is configured for connections with other transmission components in rubber cutback portion RCB (and expressly not for contact with the helical contour surface of the stator).

Figure 5A:
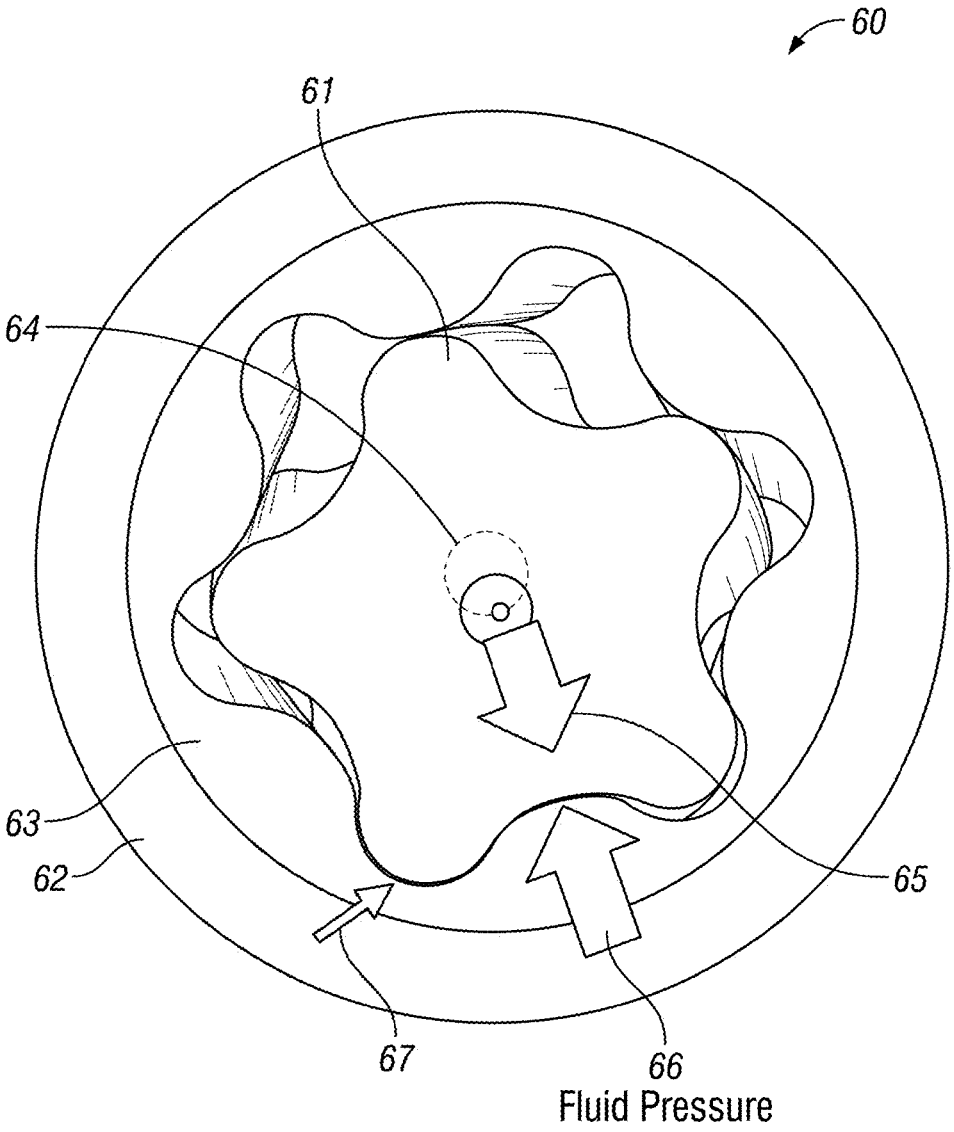
FIGS. 5A and 5B illustrate advantages of tapered stator embodiments disclosed herein on which only the minor stator diameter is tapered.
Figure 5B:
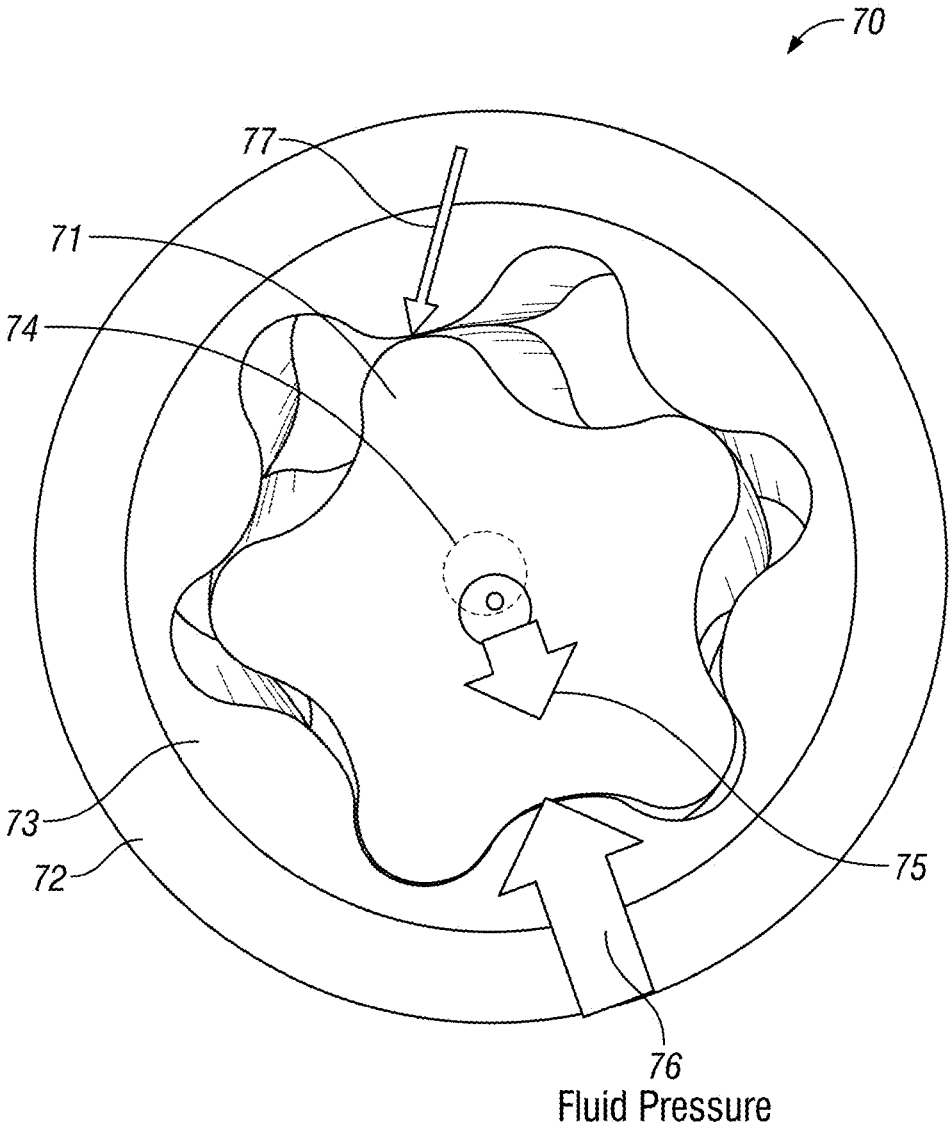

FIGS. 5A and 5B further illustrate advantages of tapered stator embodiments disclosed herein on which only the minor stator diameter is tapered. Power section 60 on FIG. 5A and power section 70 on FIG. 5B have the following common features:

Rotor 61, 71;

Stator tube 62, 72;

Stator elastomer 63, 73; and

Nominal rotational orbit of rotor center 64, 74.

Referring first to FIG. 5A, arrow 65 on power section 60 denotes that the centripetal force of rotor rotation forces the rotor 61 outwards and into stator elastomer 63 at operating speed. Arrow 66 denotes that forces from fluid pressure are wanting to lift rotor 61 off stator elastomer 63 and push back against arrow 65 at low fluid pressure and high operating RPM of rotor 61. Arrow 67 denotes that it is not ideal to reduce major diameter of stator via taper since by doing so, further rotor tilt would be encouraged. There would be less elastomer material at the major diameter, allowing arrow 65 to further push the rotor 61 off its nominal rotational orbit 64 and into the stator elastomer 63.

FIG. 5B illustrates power section 70 in a near stall condition. Arrow 75 denotes that the centripetal force urging rotor 71 outwards tends towards zero as a stall condition approaches. At this point, arrow 76 denotes that the forces from fluid pressure become most effective at or near stall conditions to lift rotor 71 off stator material 73 and to push rotor 71 off its nominal rotational orbit 74 and into opposing lobes in stator elastomer 73. Stress concentrations will result in the opposing stator lobes as a result of the rotor tilt. Note the opposing lobes are at a stator minor diameter. Arrow 77 denotes that tapering at the stator minor diameter would thus be beneficial to reduce stress concentrations in stator lobe due to the rotor tilt.

In summary, therefore, FIG. 5A illustrates that tapering the major diameter may not be ideal because to do so might encourage the rotor in yet further outward direction from its normal orbit of rotation. This would likely encourage rotor tilt rather than discourage it. Limiting the outward movement of the rotor is also important for rotor head connection clearance. Further, the rotor is constrained by the major diameter of the stator under low pressure and maximum rpm. This is desirable so that stator lobe tips do not experience excess loading in compression during rotor orbiting. Tapering the major diameter may create a stator lobe that is disadvantageously too high. Normal torsional reaction forces at low loads can tear a lobe that is too high. Combining excess orbit and high rotor speed can also tear the lobe root due to excess tensile stresses generated from torsional reaction forces.

FIG. 5B illustrates that tapering the minor diameter leaves untapered stator valleys at the major diameter to help stabilize the rotor and deter further rotor tilt. By comparison, minor diameter tapering removes rubber material from stator lobes, which reduces the potential for heavy contact with the rotor lobes in the presence of rotor tilt.

Reducing stator lobe height via minor diameter tapering also addresses the potential for stator lobe tearing during stall (or near stall) events. It was noted above that in some embodiments, the required rubber elongation to survive a stalling event is at least approximately 35% to 50% strain. Thus, in order for the power section to obtain sufficient service life and reliability in the presence of rotor tilt, a stress relieving feature (taper) is needed near the exit of the power section to obtain a factor of safety that reduces the strain to a level less than about 35% during stall conditions. This may be obtained by reducing the lobe height of the stator elastomer via minor diameter tapering starting from the outlet and extending to about 10%-50% PDM length from the outlet.

In some embodiments, the minor diameter taper near the outlet may enlarge the stator diameter at the outlet by at least 10% greater than the eccentricity (½ lobe height) of the stator profile. Such embodiments will reduce rubber strain at or near the outlet, especially in cases of heavy rotor tilt.

Preferred embodiments may thus deploy the taper based on measurements of major diameter only, being indifferent to minor diameter (which may be constant). Referring back now to the conventional stator geometry and nomenclature set forth above, taper embodiments based on major diameter only may commence at stator position Z1 at about 0.67 L measured from the stator inlet and end at stator position Z3 at 1.0 L measured from the stator inlet, in which $DMAJ3 \geq DMAJ1+(0.03\times(DMAJ3-DMAJ1)/2)$. In other embodiments deploying the taper based on major diameter only, the taper may provide a transition between stator position Z1 and stator position Z2, in which Z2 is at about 0.77 L as measured from the stator inlet, and in which $DMAJ2=DMAJ1+(0.015\times(DMAJ2-DMAJ1)/2)$.

In a similar manner, stator material with higher modulus such as hard rubber, plastic or metal can have a factor of safety calculated for the exit area of the power section where high rotor tilt is experienced. In the case of these high modulus materials, it is more appropriate to consider failure as the point where galling pressures are exceeded. For hard materials, galling and rapid material overheating/removal are the mechanisms for failure. In this case, an oversized stator minor diameter can be calculated based on a minor stator diameter modification that allows the rotor to bend and minimize stress concentrations a region spanning about 10%-50% PDM length from the outlet.

Note also that although preferred embodiments of the disclosed designs favor hard rubber throughout for power output, the scope of this disclosure is not limited in this regard.

In some embodiments of power sections including stators with tapers configured to remediate rotor tilt consistent with this disclosure, the tapered stator may include an elastomer liner having: (1) a 25% tensile modulus in a range between about 250 psi and about 1000 psi; (2) a 50% tensile modulus in a range between about 400 psi and about 1200 psi; and (3) a 100% tensile modulus in a range between about 500 psi and about 1600 psi. The scope of this disclosure is not limited in these elastomer liner modulus regards, however.

High modulus materials need not be limited to hard elastomers. Plastic, metal and hybrid stators are also within the scope of this disclosure. Aggressive tapers near the outlet of the PDM are also needed when using plastic or metal materials. In hybrid material arrangements, the highest modulus material of the stator profile is used at the exit end of the power section. Many of the high modulus materials have very low thermal expansions and so tapers addressing rotor tilt may not require further fit adjustment for thermal expansion.

When utilizing other high modulus material such as plastic or metal as the interface with a metal rotor, the galling pressure is a critical parameter that advantageously should not be exceeded. When driving the power section at high pressure or under stall conditions, a tapered exit contour is advantageous to relieve the interface pressure between the deflected rotor and minor diameter stator lobes.

In some embodiments of power sections including stators with tapers configured to remediate rotor tilt consistent with this disclosure, the power section preferably has a pressure drop capability represented by $\Delta P$, wherein $\Delta P$ is preferably at least 180 psi/stage, and more preferably at least about 200 psi/stage. As used in this disclosure, pressure drop capability ($\Delta P$) is a performance specification for the power section, and is functionally derived from a combination measurement of the stator lobe stiffness and the design rotor/stator fit (i.e. interference fit) for the power section. The stator lobe stiffness is functionally derived from a combination measurement of the stator elastomer's Modulus and the "reinforcement" behind the elastomer portion of the stator (e.g. the evenwall position or the overall rubber thickness to the outer tube). As used in this disclosure, pressure drop capability ($\Delta P$) is defined as a fluid pressure drop per stage that will cause a 25% loss in rotor RPM at 1% squeeze. "Squeeze" is defined as the reduction in stator lobe height caused by the stator lobe interference fit with the rotor lobe under normal design conditions. $\Delta P$ capability also bears on the "power section rating": Length of power section/stage length=no. of stages; and power section rating=No. of stages$\times\Delta P$ capability.

Testing Protocols

Figure 11A:
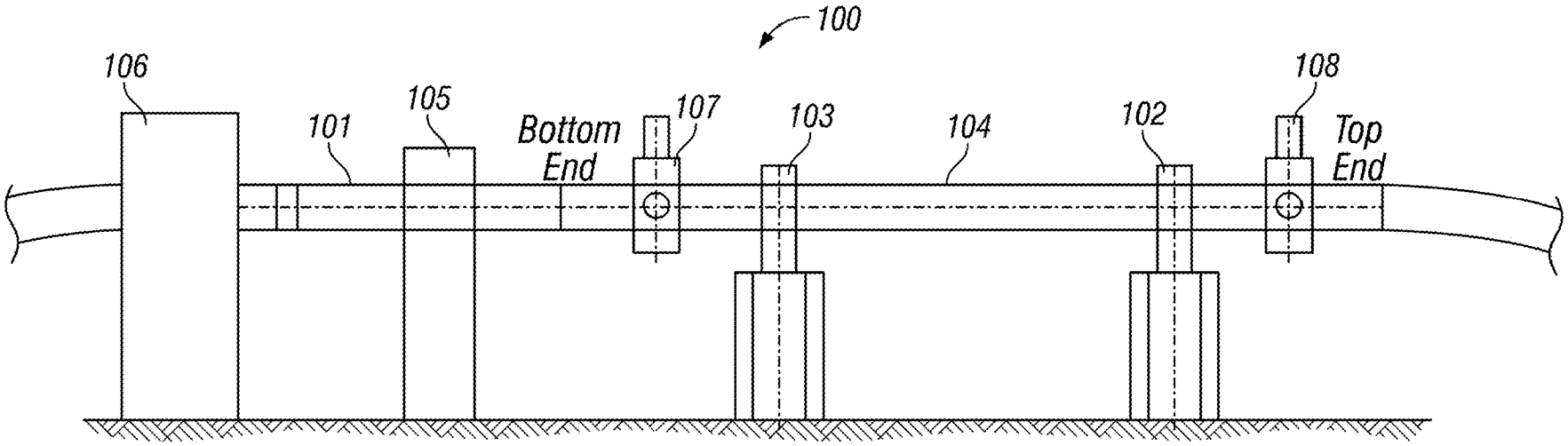
Figure 11B:
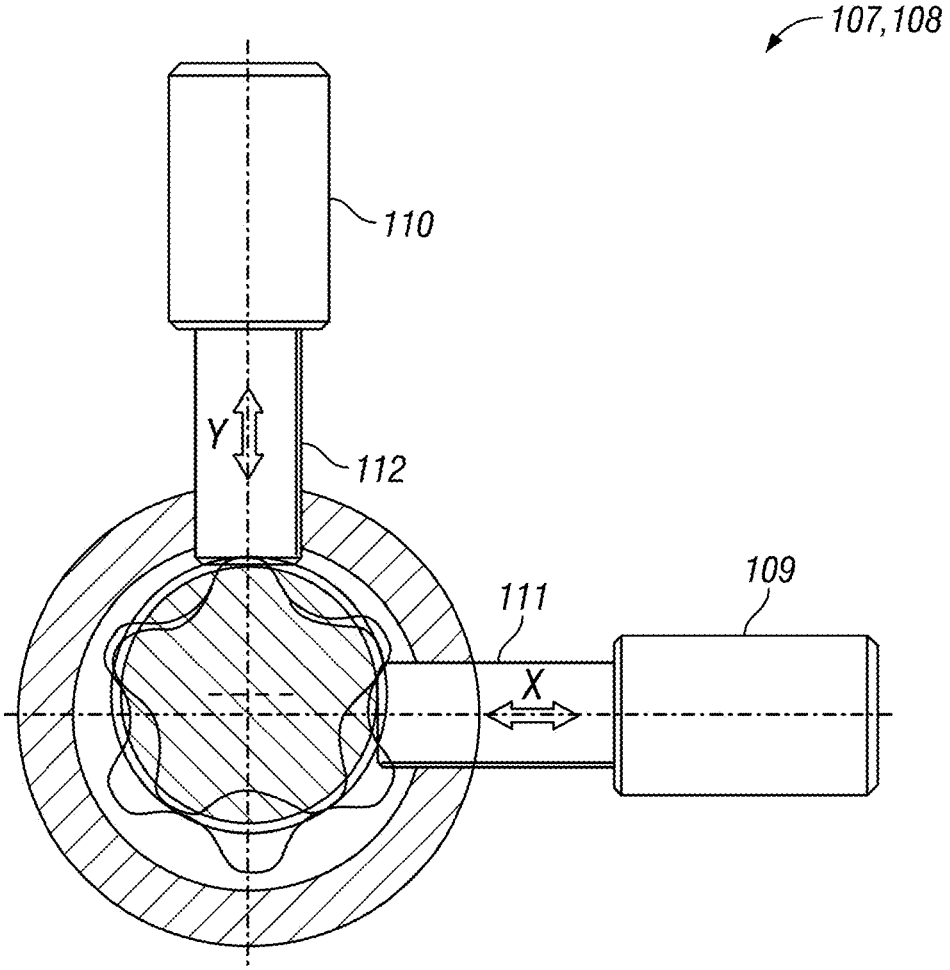

FIGS. 11A and 11B illustrate testing protocols undertaken to measure and validate the effects and remediation of rotor tilt on power section performance described in this disclosure. Note that the testing protocols described herein with reference FIGS. 11A and 11B are exemplary only, and the scope of testing available to assess rotor tilt per this disclosure is not limited to testing conceived and executed described below with reference to FIGS. 11A and 11B.

FIG. 11A illustrates test stand 100. Test stand 100 is from a conventional dynamometer ("dyno") testing apparatus in which a full-sized power section may be driven with water or drilling fluid, preferably in a flow loop. As is known, drilling fluid is pumped through the power section to drive the rotor under controlled conditions. Measurements of the power section's performance and behavior may be taken. Test stand 100 on FIG. 11B was configured to measure dynamic rotor tilt by measuring the rotor axis location at the top and bottom ends of the rotor as power section 104. The power section was mated to a motor bearing assembly 101 and clamped to test stand 100 at three (3) places: a first near the top (uphole) end (clamp 102); a second near the bottom (downhole) end (clamp 103); and a third at the motor bearing assembly (clamp 105. A threaded output shaft of the motor was attached to the dynamometer shaft, which provided adjustable rotational resistance via a multi-plate disc brake 106.

As further shown on FIG. 11A, two (2) linear position transducer assemblies 107, 108 were located at either end of the power section. Linear position transducer assemblies 107, 108 were each configured to measure eccentric rotor movement (i.e. rotor eccentricity) at their respective locations in order to determine rotor tilt.

FIG. 11B illustrates linear position transducer assemblies 107, 108 in more detail. Linear position transducer assemblies 107, 108 each provided two (2) transducers 109, 110, with transducer 109 positioned to measure eccentric rotor motion in an x-axis, and transducer 110 positioned orthogonally to transducer 109 to measure eccentric rotor motion in a y-axis. As shown on FIG. 11B, transducers 109, 110 were configured to detect/measure positions of cams 111, 112 respectively. Cams 111, 112 were positioned to contact/press against the cylindrical ends of the rotor. Spring bias between cams 111, 112 and the cylindrical ends of the rotor enabled continuous contact and measurement through the rotor's entire orbital rotation.

Raw rotor positional data from transducers 109, 110 at each of linear position transducer assemblies 107, 108 were converted to polar coordinates that provided eccentricity values at instantaneous points in time as each end of the rotor as it rotated within the stator. Data was recorded at a frequency of 2000 Hz in order to obtain rotor positional data with high granularity through a range of rotor operating speeds and other test parameters.

Tests and Test Results

Two separate power sections A and B were tested separately to record rotor tilt. Power section A was a conventional power section, nominal 5" diameter, with a 5/6 rotor/stator lobe configuration and 6.0 effective stages. Power section A further provided a stator whose elastomer was Abaco's HPW product, a hard rubber with fiber reinforcement, whose 25% tensile modulus may be in a range between about 250 psi and about 1000 psi. Power section B was identical to power section A, except that the bottom (downhole) end of the stator on power section B was adapted with a taper configured to remediate rotor tilt. The taper in power section B's stator was consistent with tapered stator embodiments described in this disclosure whose bottom-end tapers are specified herein for remediating rotor tilt.

Three test runs were performed on each of power section A and B, at 150, 250 and 350 gallons per minute drilling fluid flow rate. At each flow rate on each test run, the torque applied by the motor to the dynamometer was increased in incremental steps to create a range of differential pressures and pressure drops across the power section. The dynamometer monitored and recorded fluid pressure, flow rate, motor torque and motor speed continuously for all test runs. Rotor eccentricity was monitored and recorded continuously by linear position transducer assemblies 107, 108 for all test runs per description above with reference to FIGS. 11A and 11B.

Figure 14:
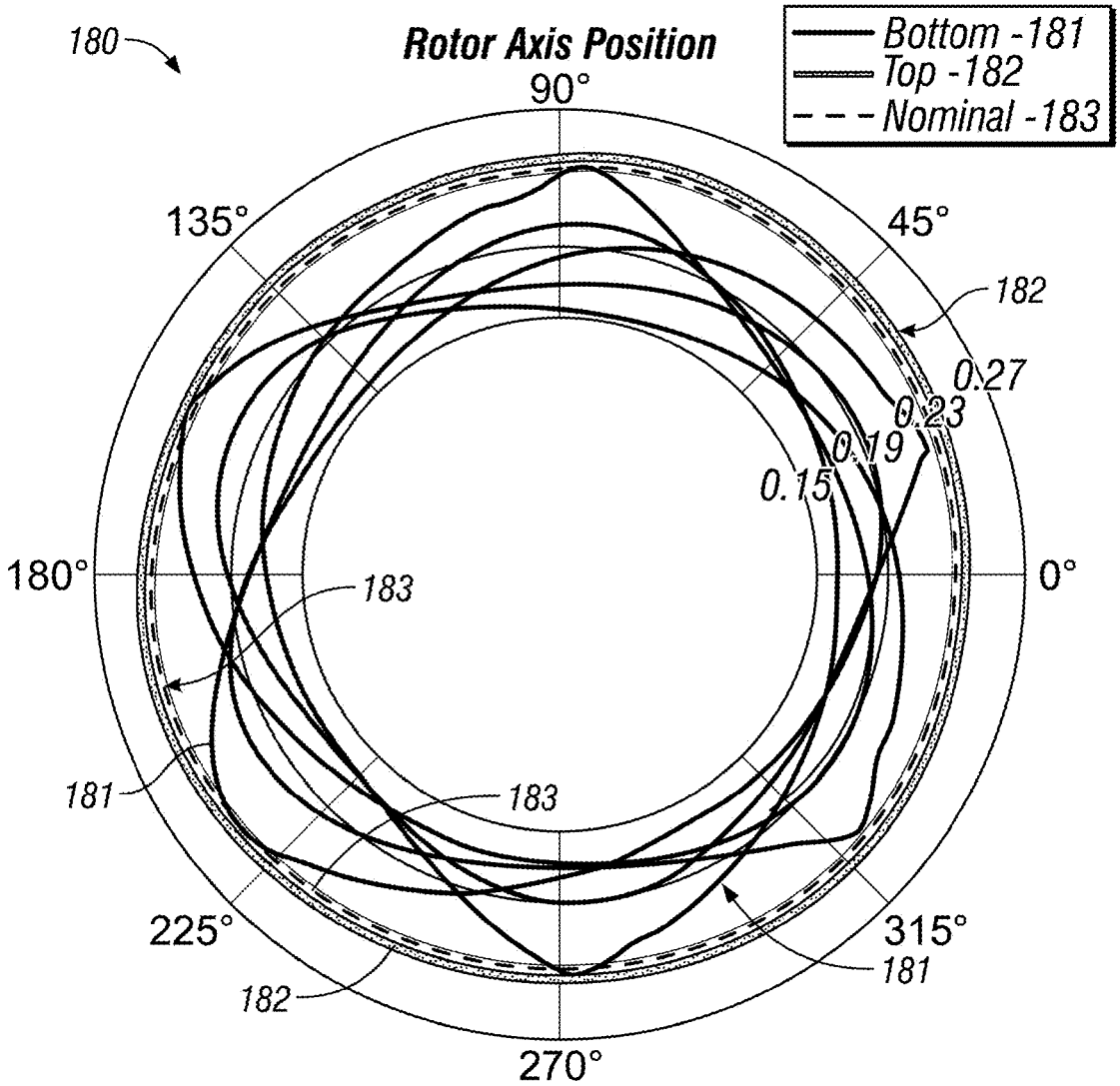
FIG. 14 is an orbital plot showing tested rotor eccentricity in a conventional power section.

FIG. 14 is an orbital plot 180 showing tested rotor eccentricity in a conventional power section (power section A) in which rotor axis position is traced at the bottom (downhole) end (dark-shaded solid lines 181) and compared to top (uphole) orbital rotor path (light-shaded solid line 182) and expected (nominal) orbital rotor path per design (broken line 183). The center of plot 180 represents the center of the stator. The rotational axis on orbital plot 180 shows the rotational position of the center of the rotor within the stator at the moment a data point was recorded, shown in degrees of orbital rotation. The radial axis on orbital plot 180 shows the radial distance of the center of the rotor from the center of the stator at the moment a data point was recorded, shown in inches. Nominal radius for the power section on plot 180 is 0.235 inches.

Lines 181, 182, 183 on plot 180 on FIG. 14 map the pathways of the rotor center at the power section positions indicated. The nominal orbital rotor path per broken line 183 represents the designed nominal pathway of the rotor center for an ideal rotor orbit. The top orbital rotor path per light-shaded solid line 182 represents the observed pathway of the rotor center at the top of the power section per the testing described above with reference to FIGS. 11A and 11B. Line 182 represents a typical data scatter for rotor eccentricity at the upper end of a conventional power section. Line 182 depicts smooth concentric bands of measured data points tightly grouped together, collectively not straying far from the nominal pathway per line 183.

In contrast, the bottom orbital rotor path per dark-shaded solid lines 181 on plot 180 on FIG. 14 represents the observed pathways of the rotor center at the bottom of the power section, again per the testing described above with reference to FIGS. 11A and 11B. Lines 181 represent a typical data scatter for rotor eccentricity for the lower end of a conventional power section. Lines 181 depict unstable, nonconcentric bands of data points not grouped together, departing substantially from nominal pathway per line 183. Interestingly, lines 181 on FIG. 14 show the dynamic behavior of the rotor at the bottom end of the power section is even more errant from nominal than was predicted via FEA on FIGS. 12A, 12B and 13 described above. FIGS. 12A, 12B and 13 predicts rotor pathway incursions at the lower end of the power section as low as 0.95 eccentricity (where 1.0 eccentricity is defined as nominal per line 183 on FIG. 14). FIG. 14 shows comparable rotor pathway incursions at the lower end of the power section as low as 0.60 eccentricity, which will inevitably increase stresses on stator lobes at and near the outlet. In summary, the testing results plotted on FIG. 14 validate the theoretical and FEA work set forth in this disclosure identifying rotor tilt as a significant PDM performance issue that may be remediated using aggressive lower end stator tapers.

Figure 15A:
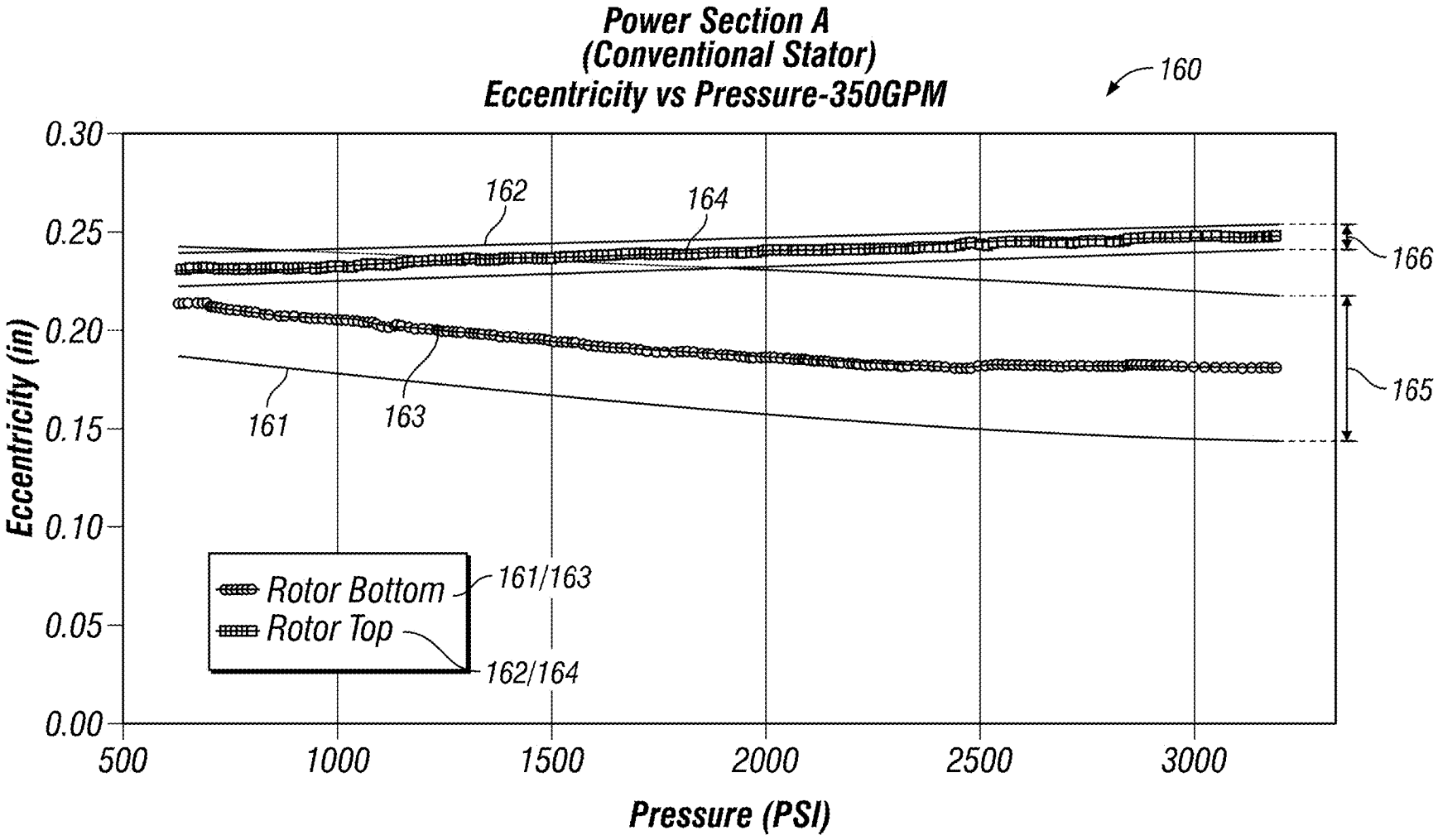
FIGS. 15A and 15B are plots 160, 170 comparing tested rotor eccentricity vs. differential fluid operating pressures at top (uphole) and bottom (downhole) ends in a power section, in which rotor behavior in a conventional stator is depicted on FIG. 15A, and rotor behavior in a power section with a stator adjusted for rotor tilt is depicted on FIG. 15B.
Figure 15B:
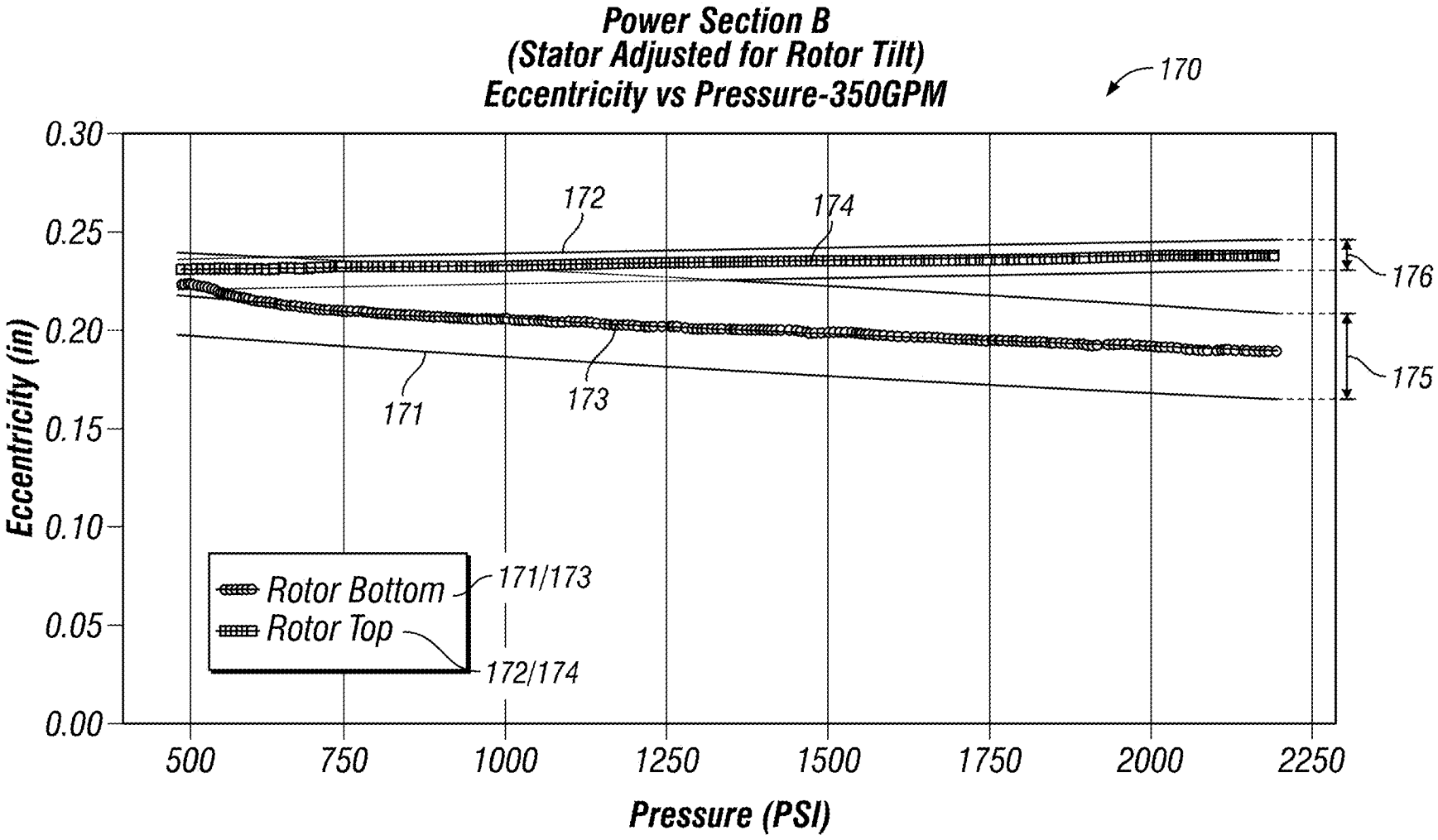

FIGS. 15A and 15B depict plots 160 and 170 respectively. Plots 160 and 170 compare rotor behavior observed and measured in power section A and power section B, respectively, according to the testing described above with reference to FIGS. 11A and 11B. To recap, power section A (FIG. 15A) is a conventional power section, and power section B (FIG. 15B) is identical to power section A, except that the bottom (downhole) end of the stator on power section B is adapted with a taper configured to remediate rotor tilt. Plots 160 and 170 on FIGS. 15A and 15B each depict rotor eccentricity vs. differential fluid operating pressures for power sections A and B, respectively, as observed and measured per the testing described above with reference to FIGS. 11A and 11B. Data points 161 about median 163 on FIG. 15A and data points 171 about median 173 on FIG. 15B are data points measured at a bottom (downhole) end of the respective power sections A and B. Data points 162 about median 164 on FIG. 15A and data points 172 about median 174 on FIG. 15B are data points measured at a top (uphole) end of the respective power sections A and B. Differential operating pressure on FIGS. 15A and 15B is depicted on the x-axis in units of psi. Rotor eccentricity on FIGS. 15A and 15B is depicted on the y-axis in units of inches. Similar to FIG. 14, rotor eccentricity in inches represents the radial distance of the center of the rotor from the center of the stator at the moment a data point was recorded.

FIG. 15A shows top end eccentricity increasing slightly with increased fluid pressure, depicting a top end eccentricity range 166 of about 0.23 inches to about 0.245 inches at low fluid pressure and a top end eccentricity range 166 of about 0.24 inches to about 0.255 inches at high fluid pressure. Top end eccentricity range 166 for power section A on FIG. 15A thus changes little with fluid pressure.

The same is true for top end eccentricity range 176 for power section B on FIG. 15B. Top end eccentricity again increases slightly on FIG. 15B with increased fluid pressure, with a top end eccentricity range 176 of about 0.225 inches to about 0.235 inches at low fluid pressure and a top end eccentricity range 176 of about 0.235 inches to about 0.245 inches at high fluid pressure.

FIG. 15B shows bottom end eccentricity decreasing with increased fluid pressure, depicting a bottom end eccentricity range 165 of about 0.18 inches to about 0.24 inches at low fluid pressure and a bottom end eccentricity range 165 of about 0.145 inches to about 0.22 inches at high fluid pressure. Bottom end eccentricity range 165 for power section A on FIG. 15B thus increases with increased fluid pressure, from about 0.06 inches at lower fluid pressure to about 0.075 inches at higher fluid pressure.

Different behavior is observed on FIG. 15B for bottom end eccentricity range 175 on power section B. Bottom end eccentricity decreases again with increased fluid pressure on power section B on FIG. 15B, although not as sharply as the decrease in bottom end eccentricity with increased fluid pressure seen for power section A on FIG. 15A. Bottom end eccentricity range 175 for power section B on FIG. 15B is about 0.2 inches to about 0.24 inches at low fluid pressure, and about 0.165 inches to about 0.215 inches at high fluid pressure. Bottom end eccentricity range 175 for power section B thus increases with increased fluid pressure, from about 0.04 inches at lower fluid pressure to about 0.05 inches at higher fluid pressure. Increased fluid pressure thus has a lesser effect on bottom end eccentricity range 175 for power section B on FIG. 15B than the effect increased fluid pressure has on bottom end eccentricity range 165 for power section A on FIG. 15A. Further, overall bottom end eccentricity deviation is demonstrably greater for power section A on FIG. 15A as compared to power section B on FIG. 15B. Bottom end eccentricity range 165 for power section A is about 50% higher than bottom eccentricity range 175 for power section B at lower fluid pressures (about 0.06 inches for power section A vs. about 0.04 inches for power section B). Bottom eccentricity range 165 for power section A is also about 50% higher than bottom eccentricity range 175 for power section B at higher fluid pressures (about 0.075 inches for power section A vs. about 0.05 inches for power section B).

The data described and compared above with reference to FIGS. 15A and 15B validate that power section B on FIG. 15B demonstrates improved performance in remediating rotor tilt over power section A on FIG. 15A. The taper in power section B's stator at or near the bottom end is engineered to be consistent with tapered stator embodiments described in this disclosure. It can be concluded that such taper embodiments described herein are effective to stabilize orbital rotation of the rotor in power section B, particularly at the lower end and/or in the presence of high differential fluid pressures.

Variations and Additional Considerations

Tapered fit varies by length from outlet by a nonlinear function that starts with aggressive slope and then shallows. Nonlinear function may be selected from a geometric function (e.g. square function), a logarithmic function or a spline function.

Tapered fit varies by length from outlet by a linear function or step function in multiple pieces.

Aggressive tapering near outlet combined with a shallow taper fit for thermal expansion fit only. Examples:

1. Inlet, 50% shallow taper, 25% straight (untapered), 25% aggressive taper, outlet.
2. Inlet, 75% shallow taper, 25% aggressive taper, outlet.

Note also manufacturing considerations—have to be able to remove and disassemble injection mold ends.

Although the inventive material in this disclosure has been described in detail along with some of its technical advantages, it will be understood that various changes, substitutions and alternations may be made to the detailed embodiments without departing from the broader spirit and scope of such inventive material.

We claim:

1. A positive displacement motor (PDM) stator, comprising:

a stator, the stator having a longitudinal centerline, the stator further including an internal elastomer liner such that the elastomer liner provides the stator with a stator internal surface, wherein the stator internal surface has lobes therein, wherein the lobes define helical pathways in the stator internal surface, wherein the helical pathways define a contour length between a contour inlet end and a contour outlet end;

wherein the stator provides a design eccentricity at the contour inlet end and an enlarged fit eccentricity at the contour outlet such that the enlarged fit eccentricity is in a range between about 102% and about 120% of design eccentricity;

wherein transverse cross-sections of the elastomer liner taken orthogonal to the longitudinal centerline provide alternating lobes and valleys around a circumference of the stator such that 2× a distance between the longitudinal centerline and a zenith point of the lobes defines a minor diameter and 2× a distance between the longitudinal centerline and a nadir point of the valleys defines a major diameter;

wherein the contour length further includes a first relief length and a second relief length disposed thereon, wherein the first relief length is located nearer the contour outlet end than the second relief length;

wherein the first relief length extends between a first relief length inlet towards the contour inlet end and a first relief length outlet towards the contour outlet end, and wherein the second relief length extends between a second relief length inlet towards the contour inlet end and a second relief length outlet towards the contour outlet end;

wherein the first relief length inlet has a first relief length inlet minor diameter and the first relief length outlet has a first relief length outlet minor diameter, and wherein the second relief length inlet has a second relief length inlet minor diameter and the second relief length outlet has a second relief length outlet minor diameter;

wherein the first relief length outlet minor diameter is larger than the first relief length inlet minor diameter according to a first relief enlargement rate, and wherein the second relief length outlet minor diameter is larger than the second relief length inlet minor diameter according to a second relief enlargement rate;

wherein the first relief enlargement rate is more aggressive than the second relief enlargement rate; and wherein the first relief length inlet is located at least 10% of the contour length from the contour outlet.

2. The PDM stator of claim 1, in which the first relief length inlet is located in a range between about 10% and about 50% of the contour length from the contour outlet.

3. The PDM stator of claim 1, in which the first relief length inlet minor diameter increases at least in part towards the first relief length outlet minor diameter according to a first relief taper profile.

4. The PDM stator of claim 3, in which the first relief taper profile is non-linear at least in part.

5. The PDM stator of claim 3, in which the first relief taper profile is according at least in part to a non-linear function selected from the group consisting of (a) a geometric function, and (b) a logarithmic function.

6. The PDM stator of claim 1, in which the first relief length inlet minor diameter increases at least in part towards the first relief length outlet minor diameter according to a first relief step function.

7. The PDM stator of claim 6, in which the first relief step function is a spline function at least in part.

8. The PDM stator of claim 1, in which the second relief length inlet minor diameter increases at least in part towards the second relief length outlet minor diameter according to a second relief taper profile.

9. The PDM stator of claim 8, in which the second relief taper profile is non-linear at least in part.

10. The PDM stator of claim 8, in which the second relief taper profile is according at least in part to a non-linear function selected from the group consisting of (a) a geometric function, and (b) a logarithmic function.

11. The PDM stator of claim 1, in which the second relief length inlet minor diameter increases at least in part towards the second relief length outlet minor diameter according to a second relief step function.

12. The PDM stator of claim 11, in which the second relief step function is a spline function at least in part.

13. The PDM stator of claim 1, in which the elastomer liner has a tensile stress greater than 800 psi at 100% elongation.

14. The PDM stator of claim 1, in which the elastomer liner has an elongation at break between 80% and 270%.

15. A positive displacement motor (PDM) stator, comprising:

a stator, the stator having a longitudinal centerline; and the stator further including an internal elastomer liner such that the elastomer liner provides the stator with a stator internal surface, wherein the stator internal surface has lobes therein, wherein the lobes define helical pathways in the stator internal surface, wherein the helical pathways define a contour length between a contour inlet end and a contour outlet end;

wherein transverse cross-sections of the elastomer liner taken orthogonal to the longitudinal centerline provide alternating lobes and valleys around a circumference of the stator such that 2× a distance between the longitudinal centerline and a zenith point of the lobes defines a minor diameter and 2× a distance between the longitudinal centerline and a nadir point of the valleys defines a major diameter;

wherein the contour length further includes a first relief length disposed thereon, wherein the first relief length extends between a first relief length inlet towards the contour inlet end and a first relief length outlet towards the contour outlet end;

wherein the first relief length inlet has a first relief length inlet minor diameter and the first relief length outlet has a first relief length outlet minor diameter;

wherein the first relief length outlet minor diameter is larger than the first relief length inlet minor diameter by a first relief enlargement rate such that the first relief enlargement rate is more than 0.0002 inches per inch of first relief length; and wherein the first relief length inlet minor diameter increases towards the first relief length outlet minor diameter at least in part according to a step function and at least in part according to a linear function.

16. The PDM stator of claim 15, in which the step function is a spline function at least in part.

17. The PDM stator of claim 15, in which the elastomer liner has a tensile stress greater than 800 psi at 100% elongation.

18. The PDM stator of claim 15, in which the elastomer liner has an elongation at break between 80% and 270%.

19. The PDM stator of claim 15, in which:

the contour length further includes a second relief length disposed thereon;

wherein the first relief length is located nearer the contour outlet end than the second relief length;

wherein the second relief length extends between a second relief length inlet towards the contour inlet end and a second relief length outlet towards the contour outlet end;

wherein the second relief length inlet has a second relief length inlet minor diameter and the second relief length outlet has a second relief length outlet minor diameter;

wherein the second relief length outlet minor diameter is larger than the second relief length inlet minor diameter according to a second relief enlargement rate; and wherein the first relief enlargement rate is more aggressive than the second relief enlargement rate.

20. The PDM stator of claim 19, in which the first and second relief lengths are contiguous.

21. A positive displacement motor (PDM) stator, comprising:

a stator, the stator having a longitudinal centerline; and the stator further including an internal elastomer liner such that the elastomer liner provides the stator with a stator internal surface, wherein the stator internal surface has lobes therein, wherein the lobes define helical pathways in the stator internal surface, wherein the helical pathways define a contour length between a contour inlet end and a contour outlet end;

wherein transverse cross-sections of the elastomer liner taken orthogonal to the longitudinal centerline provide alternating lobes and valleys around a circumference of the stator such that 2× a distance between the longitudinal centerline and a zenith point of the lobes defines a minor diameter and 2× a distance between the longitudinal centerline and a nadir point of the valleys defines a major diameter;

wherein the contour length further includes a first relief length disposed thereon, wherein the first relief length extends between a first relief length inlet towards the contour inlet end and a first relief length outlet towards the contour outlet end;

wherein the first relief length inlet has a first relief length inlet minor diameter and the first relief length outlet has a first relief length outlet minor diameter;

wherein the first relief length outlet minor diameter is larger than the first relief length inlet minor diameter by a first relief enlargement rate such that the first relief enlargement rate is more than 0.0002 inches per inch of first relief length; and wherein the first relief length inlet minor diameter increases towards the first relief length outlet minor diameter according to a non-linear function.

22. The PDM stator of claim 21, in which the non-linear function is selected from the group consisting of (a) a geometric function, and (b) a logarithmic function.

* * * * *